US007909583B2

(12) United States Patent
Sugimoto et al.

(10) Patent No.: US 7,909,583 B2
(45) Date of Patent: Mar. 22, 2011

(54) PUMP APPARATUS AND PUMP UNIT THEREOF

(75) Inventors: Hiroshi Sugimoto, Kyoto (JP); Yoshio Sone, Kyoto (JP); Tetsuro Ohbayashi, Tokyo (JP)

(73) Assignee: Osaka Vacuum, Ltd., Osaka (JP)

( * ) Notice: Subject to any disclaimer, the term of this patent is extended or adjusted under 35 U.S.C. 154(b) by 161 days.

(21) Appl. No.: 10/599,236

(22) PCT Filed: Mar. 23, 2005

(86) PCT No.: PCT/JP2005/005211

§ 371 (c)(1), (2), (4) Date: Sep. 22, 2006

(87) PCT Pub. No.: WO2005/090795

PCT Pub. Date: Sep. 29, 2005

(65) Prior Publication Data

US 2008/0159877 A1 Jul. 3, 2008

(30) Foreign Application Priority Data

Mar. 23, 2004 (JP) ..... 2004-085050

(51) Int. Cl.
*F04B 37/02* (2006.01)

(52) U.S. Cl. ..... 417/51; 417/207

(58) Field of Classification Search ..... 417/51, 417/207

See application file for complete search history.

(56) References Cited

U.S. PATENT DOCUMENTS 2,465,685 A * 3/1949 Henderson ..... 219/536
3,150,818 A * 9/1964 Schumacher ..... 417/207
3,167,678 A * 1/1965 Griessel ..... 313/554
3,365,383 A * 1/1968 Blair ..... 422/186.19
4,338,065 A * 7/1982 Desor ..... 417/207
4,400,950 A * 8/1983 Knabben ..... 62/238.6
4,571,158 A * 2/1986 Maegdefessel ..... 417/51
4,936,145 A * 6/1990 Hohenstatt ..... 73/204.26
5,871,336 A 2/1999 Young
6,533,554 B1 * 3/2003 Vargo et al. ..... 417/207

FOREIGN PATENT DOCUMENTS

JP 59130519 7/1984
JP 61169680 7/1986
JP 2001223263 8/2001

OTHER PUBLICATIONS

Sone et al. ,Journal of the Vacuum science of Japan,vol. 45, No. 3 (2002),pp. 138-141.*

(Continued)

*Primary Examiner* — Devon C Kramer
*Assistant Examiner* — Amene S Bayou
(74) *Attorney, Agent, or Firm* — Edwards Angell Palmer & Dodge LLP; Peter C. Schechter; Brian R. Landry

(57) ABSTRACT

A pump device and a pump unit of the pump device. The pump device includes a low-temperature flat plate group (low-temperature portion) having a plurality of flat plates as low-temperature objects arranged parallel with each other at specified intervals in a direction crossing a flow passage for a gas; a high-temperature flat plate group (high-temperature portion) having a plurality of flat plates as high-temperature objects arranged parallel with each other at specified intervals in a direction crossing the flow passage; and, a temperature-operating device operating the temperature of at least one of these flat plate groups so that a temperature difference occurs between these flat plate groups. The flat plates are displaced from each other in the flow direction of the flow passage, and a heat insulating layer is interposed between the low-temperature flat plates and the high-temperature flat plates.

18 Claims, 34 Drawing Sheets

OTHER PUBLICATIONS

Sone, Y. et al., "Vacuum Pump Without a Moving Part and it's Performance." Rarefied Gas Dynamics, ed. A.D. Ketsdever & E.P. Muntz (AIP, New York, 2003) p. 1041-1048.

Aoki, K. et al., "A Rarefied Gas Flow Induced by a Temperature Field." Rarefied Gas Dynamics, ed. G. Lord (Oxford U.P., Oxford, 1995) p. 35-41.

Sone, Y., et al., "Demonstation of a Rarefied Gas Flow Induced Near the Edge of a Uniformly Heated Plate." Phys. Fluids 9 (1997) p. 3530-3534.

* cited by examiner

PUMP APPARATUS AND PUMP UNIT THEREOF

CROSS-REFERENCE TO PRIOR APPLICATION

This is a U.S. National Phase Application under 35 U.S.C. §371 of International Patent Application No. PCT/JP2005/005211 filed Mar. 23, 2005, and claims the benefit of Japanese Patent Application No. 2004-085050, filed Mar. 23, 2004, both of them are incorporated by reference herein. The International Application was published in Japanese on Sep. 29, 2005 as WO 2005/090795 A1 under PCT Article 21(2).

TECHNICAL FIELD

The present invention relates to a pump apparatus utilizing thermal edge flow.

BACKGROUND ART

As a vacuum pump utilized for industry, there are a pumping-out type pump and an entrapment type pump. The pumping-out type pump is a pump in which gas is sucked from an intake port, compressed inside of the pump, and drawn out from an exhaust port. A mechanical pump in which gas is compressed by rotating blades or gears using a motor is one of pumping-out type pumps, and as for this kind of pumps, such as an oil rotary pump, a diaphragm pump, a roots pump, and a turbo molecular pump are of practical use. In addition, a steam jet type pump which kicks out gaseous molecules using a high-speed oil vapor jet is also one of the pumping-out type pumps. On the other hand, the entrapment type pump is a pump which decompresses an outside of the pump by capturing gas into an inside thereof from the outside and performs recovery operation in which the captured gas is discharged to the atmosphere after the pumping operation is finished. For this kind of pumps, such as a cryopump, a sorption pump and a getter pump are utilized.

In recent years, a new type vacuum pump called as a Knudsen compressor has been studied as one of the pumping-out type pumps (refer to the patent documents 1, 2 and non-patent document 1, for example). This pump (a compressor is considered to be one concept of a pump in this specification) utilizes thermal transpiration flow in which gas flows from low-temperature side to high-temperature side in a pipe which has a temperature gradient along its axis. The Knudsen compressor is significantly different from prior mechanical pumps in the point that the gas can be transported without using moving parts.

In addition, as a behavior of gas to be generated owing to a temperature field of the gas, existence of thermal edge flow by which gas flow is induced in a periphery of a sharp edge of an object when the object is put in a gas atmosphere being heated or cooled has been pointed out (non-patent document 2), and it has been experimentally confirmed (non-patent document 3). However, a pump apparatus utilizing the thermal edge flow has not been considered at all.

Patent document 1: U.S. Pat. No. 5,871,336

Patent document 2: JP-A-2001-223263

Non-patent document 1: Y. Sone and H. Sugimoto, Vacuum pump without a moving part and its performance, in Rarefied Gas Dynamics, ed. by A. D. Ketsdever and E. P. Muntz (AIP, New York, 2003) 1041-1048

Non-patent document 2: K. Aoki, Y. Sone, and N. Masukawa, "A rarefied gas flow induced by a temperature field," in Rarefied Gas Dynamics, ed. by G. Lord (Oxford U.P., Oxford, 1995) 35-41

Non-patent document 3: Y. Sone and M. Yoshimoto, "Demonstration of a rarefied gas flow induced near the edge of a uniformly heated plate," Phys. Fluids 9 (1997) 3530-3534

DISCLOSURE OF THE INVENTION

Problem to be Solved by the Invention

In a Knudsen compressor utilizing the thermal transpiration flow, a pressure difference between the intake side and the exhaust side or an exhaust flow rate increases with increasing temperature gradient. However, to realize a great temperature gradient, a high-temperature portion and a low-temperature portion need to be come close each other as possible in the passage. As a result, it is required to cool the surface of one side of a continuous wall, which constitutes the passage, by using a cooler while the vicinity of the cooler is heated by using a heater. In such a configuration, since heat is transmitted through the wall surface so as to cancel a temperature gradient between the high-temperature portion and the low-temperature portion, energy efficiency is inferior, and consumption energy is extremely large in comparison with provided pump performance.

Therefore, one object of the present invention is to provide a pump apparatus utilizing thermal edge flow to improve energy efficiency in comparison with a prior Knudsen compressor.

Means for Solve the Problem

A pump apparatus according to the present invention solves the above described problem by comprising: a low-temperature portion having a plurality of low-temperature bodies arranged with intervals in a crossing direction in a passage of gas; a high-temperature portion having a plurality of high-temperature bodies arranged with intervals in the crossing direction in the passage; and temperature operation means for operating at least one of temperatures of the low-temperature portion or the high-temperature portion so that a temperature of the high-temperature portion is higher than that of the low-temperature portion, wherein the low-temperature bodies and the high-temperature bodies are displaced from each other in a flow direction in the passage, and a heat insulating layer by the gas exists between the low-temperature bodies and the high-temperature bodies.

In order to generate the thermal edge flow, it is necessary that i) a wall surface serving as a solid boundary exists in gas, and ii) when gaseous molecules which arrived at an arbitrary point on the wall surface is considered, there is a difference between an average speed of the gaseous molecules flying from one side of a plane including the point and perpendicular to the wall surface and an average speed of the gaseous molecules flying from the other side. According to the pump apparatus of the present invention, since in vicinity of the low-temperature bodies and the high-temperature bodies, edges of these bodies provide solid boundaries, and at an arbitrary point in vicinity of those bodies, there is a difference of average speeds between the gaseous molecules flying from the low-temperature body side and the gaseous molecules flying from the high-temperature body side, the above-described two conditions are satisfied. Accordingly, it is induced one direction flow of the gas which directs from the low-temperature portion to the high-temperature portion, and a pump effect is obtained. In addition, in the present invention, the high-temperature and the low-temperature bodies do not contact each other. That is to say, the two bodies are away from each other. Therefore, a heat insulating layer (in this case, gas layer) becomes to exist between the low-temperature bodies and the high-temperature bodies, even if the low-temperature portion and the high-temperature portion come close to each other, and then it is easy to magnify the temperature gradient between the low-temperature side and the high-temperature side in comparison with the case that both contacts each other, thereby enhancing energy efficiency.

In one embodiment of the pump apparatus according to the present invention, the low-temperature bodies and the high-temperature bodies may alternately be arranged with respect to the crossing direction, and in this case, the low-temperature bodies and the high-temperature bodies may partly be overlapped in the flow direction. Alternatively, the high-temperature bodies and the low-temperature bodies may be linearly arranged in the flow direction.

In one embodiment of the pump apparatus according to the present invention, a group of first flat plates arranged parallel with each other in the crossing direction may be provided as the low-temperature bodies in the low-temperature portion, and a group of second flat plates arranged parallel with each other in the crossing direction may be provided as the high-temperature bodies in the high-temperature portion. Alternatively, at least one of each low-temperature body or each high-temperature body may be configured in a column shape. Further, a porous material body may be provided as at least one of the low-temperature portion or the high-temperature portion, and wall portions surrounding permeable holes of the porous material body may serve as the low-temperature bodies or the high-temperature bodies.

In one embodiment according to the present invention, intervals between the low-temperature bodies adjacent to each other in the crossing direction and intervals between the high-temperature bodies adjacent to each other in the crossing direction may be set within a range from several hundred times to one-several hundredth of a mean free path of gaseous molecules in a working pressure of the pump apparatus, respectively. Edges of vicinity portions of each of the low-temperature bodies and the high-temperature material body may have a radius of curvature equal to or less than a mean free path of gaseous molecules. Further, a plurality of pump units may be connected with respect to the flow direction, and the low-temperature portion and the high-temperature portion may be provided in each pump unit.

A pump unit according to the present invention solves the above described problem by comprising: a low-temperature portion having a plurality of low-temperature bodies arranged with intervals in a crossing direction in a passage of gas; and a high-temperature portion having a plurality of high-temperature bodies arranged with intervals in the crossing direction in the passage, wherein the low-temperature bodies and the high-temperature bodies are displaced from each other in a flow direction in the passage, and a heat insulating layer by the gas exists between the low-temperature bodies and the high-temperature bodies. By using such a pump unit solely or connecting a plurality of pump units in the flow direction and providing a temperature gradient between the low-temperature portion and the high-temperature portion, a pump effect in the pump apparatus according to the present invention can be obtained.

One embodiment of the pump unit according to the present invention, a group of first flat plates arranged parallel with each other in the crossing direction may be provided as the low-temperature bodies in the low-temperature portion, and a group of second flat plates arranged parallel with each other in the crossing direction may be provided as the high-temperature bodies in the high-temperature portion. In this case, the pump unit may comprise a hollow flange constructing a pump housing and a heater unit connected to the flange through a heat insulating portion, the group of first flat plates may be attached to the flange so as to cross a hollow portion of the flange, and the heater unit may be provided with a heating element made by folding a heating wire material into an accordion form so as to form the group of the second flat plates. The heater unit may be provided with a frame to which the heating element is attached and a wire stretched around the frame, and connection means for connecting the wire and the flange may serve as the heat insulating portion. A plurality of pipe-like insulation members may be fixed to the frame, the wire may be connected to the frame by being passed through the insulation members and the connection means may connect the flange and the wire. The connection means may include a floating mechanism supporting the heater unit at a plurality of points. The flange may be provided with a coolant passage through which a coolant passes.

Incidentally, in the present invention, if a plurality of pump units are connected in series with respect to the flow direction, temperatures at both ends of each pump unit need to be set equally to each other. Further, to make pump effect occur in each pump unit, it is necessary that geometry of one set of the unit does not overlap with a system which is folded back to the flow direction. Then, in the case where a pump apparatus is constructed by connecting a lot of pump units in series, great pressure difference can be realized at both ends of the pump apparatus.

Effect of the Invention

As described above, according to the present invention, since the group of low-temperature bodies and the group of high-temperature bodies, which have different temperatures, are arranged in the state that the heat insulating layers exist therebetween to thereby allow the thermal edge flow of the same direction to be generated in vicinity of the low-temperature bodies and the high-temperature bodies, it is possible to realize a pump apparatus superior in energy efficiency in comparison with the prior Knudsen compressor in which the temperature gradient is made to be generated on the continuing wall surface.

EXPLANATION OF THE REFERENCE NUMERALS

1 Container
2 Flat Plate
3 Wall Surface
4 Passage
5 Flat Plate on Low-Temperature Side (Low-Temperature Bodies)
5*a* Front Edge
5*b* Rear Edge
6 Flat Plate on High-Temperature Side (High-Temperature Bodies)
6*a* Front Edge
6*b* Rear Edge
7 Cylindrical Body (Flat Plate)
11 Elliptic Pipe
12 Elliptic Cylinder
13,14 and 18 Low-Temperature Bodies

15,16 and 17 High-Temperature Bodies
20 Vacuum Pump
21 Pump Unit
22 Flange
23 Low-Temperature Flat Plate Group
24 High-Temperature Flat Plate Group
25 Hollow Portion of Flange
28 Fin Mounting Groove
33 Water Through Hole (Coolant Passage)
36 Cooling Fin (Flat Plate on Low-Temperature Side)
40 Heater Unit
41 Frame
42 Heating Element
43 Support Mechanism
45 Heating Fin (Flat Plate on High-Temperature Side)
51 Insulation Member
52 Wire
53 Supporting Ring
55 Floating Mechanism
60 Pump Housing
61 Inner Flow Path
62 Cooling Passage
65 Heater Power Supply
66 Cooling Water Feeder
70 Heat Generating Portion
71 Heater
80 First Gas Permeability Sheet (Low-Temperature Portion)
81 Second Gas Permeability Sheet (High-Temperature Portion)
90 Exhaust Pump
91 Opening and Closing Valve
92 vacuum Tank
C Low-Temperature Flat Plate Group (Low-Temperature Portion)
H High-Temperature Flat Plate Group (High-Temperature Portion)

BEST MODE FOR CARRYING OUT THE INVENTION

The First Embodiment

Figure 1A:
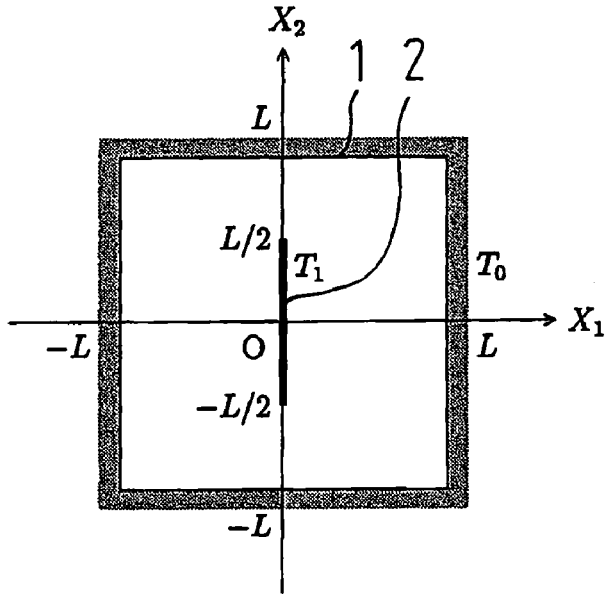
FIG. 1A is a view showing two-dimension model to describe thermal edge flow.
Figure 1B:
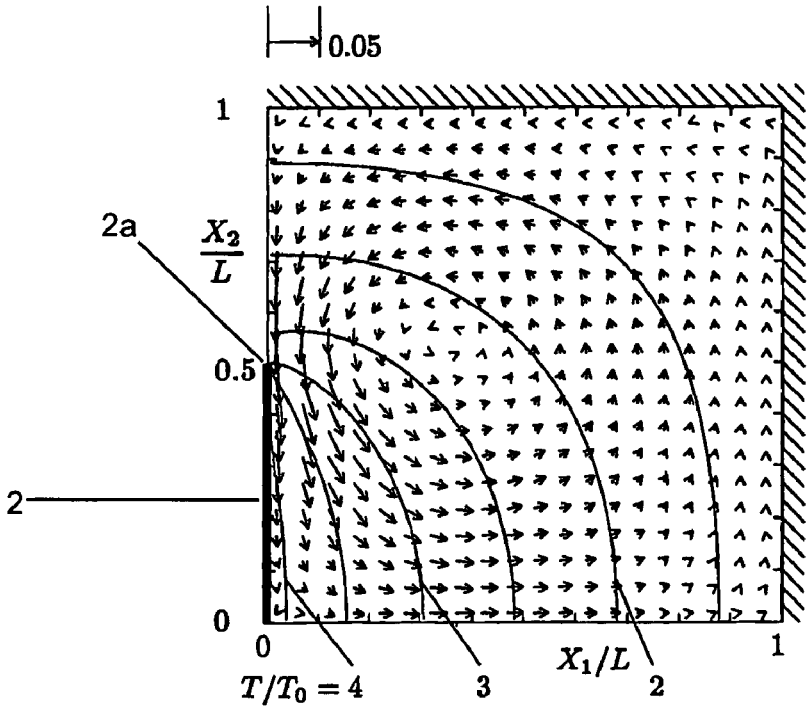
FIG. 1B is a view showing simulation result of flow in the model of FIG. 1A.

First of all, in order to facilitate the understanding of a pump apparatus according to one embodiment of the present invention, an example of thermal edge flow will be explained. As show in FIG. 1A, the case in which a flat plate 2 of temperature $T_1$ is placed in the central of a square container 1 of temperature $T_0$ is considered. FIG. 1B shows flow vectors and a state of isothermal lines obtained by a numerical simulation regarding flow in the container 1. Incidentally, only the first quadrant is shown in FIG. 1B when the center of the flat plate 2 is made to be an origin, the direction perpendicular to the flat plate 2 is set to be $X_1$ axis, and the direction parallel to the flat plate 2 is set to be $X_2$ axis. The result of the numerical simulation shown here is obtained when $T_1/T_0=5$ and the mean free path of gaseous molecules in the container 1 corresponds to 5% of the width of the flat plate 2. According to FIG. 1B, it is recognized that, in the vicinity of an edge portion 2*a* of the flat plate 2, the temperature of the gas suddenly changes, and the flow from the low-temperature side to the high-temperature side is generated. Such flow is the thermal edge flow.

Figure 2A:
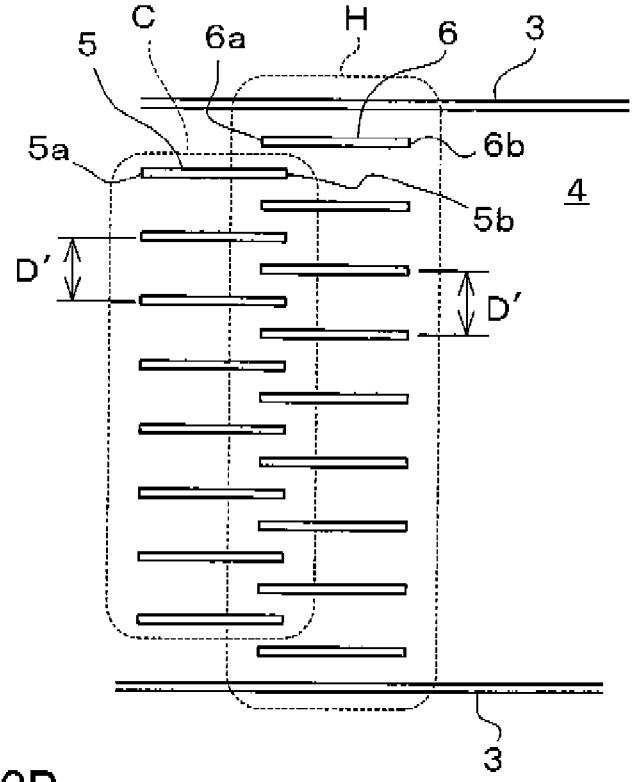
FIG. 2A is a view showing the simplified first embodiment of a pump apparatus according to the present invention.
Figure 2B:
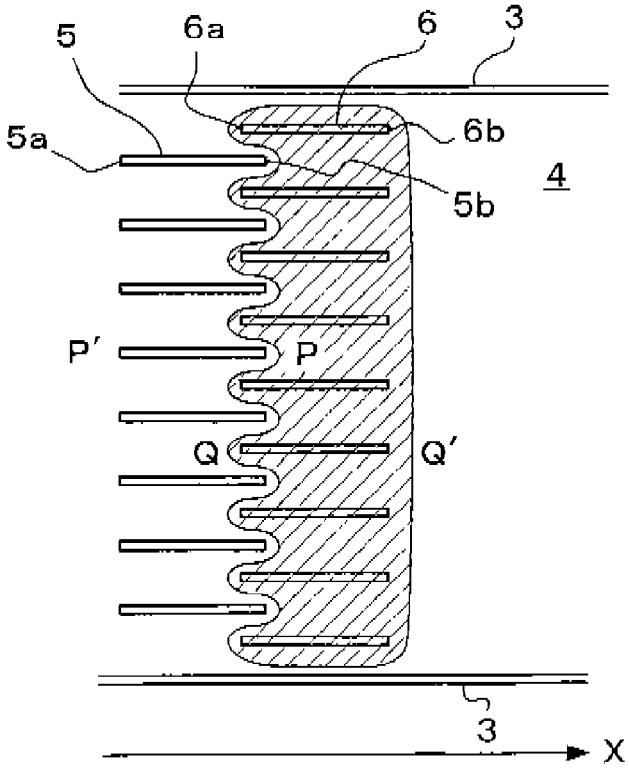
FIG. 2B is a view showing a temperature distribution expected in the embodiment of FIG. 2A.

Next, a pump apparatus according to one embodiment of the present invention will be described. FIG. 2A and FIG. 2B show one simplified embodiment of the pump apparatus according to the present invention. In the pump apparatus, there is provided a low-temperature flat plate group (a low-temperature portion) C as a group of the first flat plates and a high-temperature flat plate group (a high-temperature portion) H as a group of the second flat plates in a passage 4 defined by a pair of wall surfaces 3. The flow direction of gas in the passage 4 is the positive direction of the X-axis in FIG. 2B. In the low-temperature flat plate group C, a plurality of flat plates 5 are arranged so as to be parallel to each other with constant intervals along a direction crossing the passage 4 concretely, the direction perpendicular to the flow direction in the passage). In the high-temperature flat plate group H, a plurality of flat plates 6 are arranged so as to be parallel to each other with constant intervals along the same direction as that of the flat plates 5 in the low-temperature flat plate group C. The flat plates 5 and the flat plates 6 are arranged along the flow direction of the passage 4 so as not to contact each other. Each flat plate 6 in the high-temperature flat plate group H is arranged at a position equidistance from an adjacent pair of the flat plates 5 in the low-temperature flat plate groups C, in other words, the position dividing the gap between the flat plates 5 in halves. However, the position of the flat plate 6 is not limited to the position dividing the gap between the flat plates 5 in halves, it is sufficient that the flat plate 6 in the high-temperature flat plate group H is arranged between the pair of the adjacent flat plates 5 in the low-temperature flat plate group C. With respect to the flow direction in the passage 4, the rear end portions 5*b* of the flat plates 5 in the low-temperature flat plate group C and the front end portions 6*a* of the flat plates 6 in the high-temperature flat plate group H are overlapped each other in a certain length. That is to say, the flat plates 5 and the flat plates 6 are arranged so that the edges 5*a* and 6*a* are arranged alternately with constant intervals W.

In the pump apparatus as described above, the case in which the temperature $T_H$ of the flat plates 6 in the high-temperature flat plate group H is set higher than the temperature $T_C$ of the flat plates 5 in the low-temperature flat plate group C will be studied. First of all, focusing the temperature distribution at the overlapping portion of the flat plates 5 and the flat plates 6 (the portion overlapping along the flow direction), in this portion, due to the temperature difference between the two flat plate groups C and H, a great temperature gradient is generated in the gas of periphery. On the other hand, in periphery of the front edge portions 5*a* of the flat plates 5 and periphery of the rear end portions 6*b* of the flat plates 6, since only the flat plates 5 of the low temperature or the flat plates 6 of the high temperature continue, uniform temperature fields having almost the same temperature as the flat plate temperatures $T_C$ or $T_H$ are produced. From above-described result, the temperature distribution near the flat plate groups C and H becomes as shown in FIG. 2B. Here, the hatching region in the figure shows a high-temperature portion.

If the temperature of each of the flat plates 5 and 6 is almost constant from the front edge portion 5*a* or 6*a* to the rear end portion 5*b* or 6*b*, the thermal transpiration does not occur on each of the flat plates 5 and 6. On the contrary, in the rear edge portions 5*b* of the flat plates 5 and the front edge portions 6*a* of the flat plates 6, the thermal edge flow occurs, because the temperature gradient is occurring in the gas of periphery. To consider it more concretely, it becomes as follows.

First, at the point P vicinity of the rear edge portions 5*b* of the flat plates 5 on the low-temperature side, there are gaseous molecules of low-temperature in −X direction, and there are gaseous molecules of high-temperature in +X direction. In the environment in which a temperature gradient is generated, since the gaseous molecules show tendency to move toward the high-temperature side, +X direction flow (the thermal edge flow) is induced at the point P. At the point Q vicinity of the front edge portions 6*a* of the flat plates 6 on the high-temperature side, the phenomenon as the same as the above occurs and +X direction flow is induced. On the other hand, at the point P' vicinity of the front edge portions 5*a* of the flat plates 5 and the point Q' vicinity of the rear edge portions 6*b* of the flat plates 6, since the gas temperature of periphery is almost constant at $T_C$ or $T_H$, the flow does not occur.

As it is apparent from the above-described discussion, in FIG. 2B, only in the peripheries of the rear edge portions 5*b* of the flat plates 5 and the front edge portions 6*a* of the flat plates 6, the flow of the gas is induced, and both of the flow directions are +X direction. Therefore, the flow to +X direction occurs in the entirety of the apparatus. The pump apparatus according to one embodiment of the present invention serves as a pump by such a principle.

In the pump apparatus of one embodiment according to the present invention, each of the first flat plate group C on the low-temperature side and the second flat plate group H on the high-temperature side comprises a plurality of the flat plates 5 or 6, respectively. In the configuration in which single flat plate is arranged on each of the low-temperature side and the high-temperature side and those flat plates are arranged along the flow direction, at the both ends of each flat plate, the thermal edge flow which directs oppositely to each other occurs. Thus, considering the entirety of the apparatus, it is difficult to generate an effective flow, because those flows are canceled each other. In the pump apparatus according to one embodiment of the present invention, the flat plates 6 on the high-temperature side and the flat plates 5 on the low-temperature side do not contact each other. That is to say, two flat plate groups C and H are apart from each other. Therefore, a heat insulating layer (in this case, a gas layer) comes to exist between the flat plates, so that even if the flat plates come close to each other, it is easy to enhance energy efficiency by magnifying a temperature gradient between both in comparison with the case in which the flat plates contact each other. In addition, in FIG. 2A and FIG. 2B, with respect to the direction crossing the passage 4, the flat plates 5 on the low-temperature side and the flat plates 6 on the high-temperature side are arranged alternately, however, it is not essential for the present invention. It is sufficient that the flat plates 5 and the flat plates 6 are arranged along the flow direction so as not to contact each other. For example, both may be linearly arranged along the flow direction (refer to FIG. 28). The heat insulating layer between the flat plate groups is not limited to the gas layer, and an insulating material consist of the material having thermal insulation performance which can sufficiently restrain the heat conduction between the flat plate groups may be arranged between the flat plate groups. In brief, it is sufficient in the present invention that both of the flat plate groups are separated without other members existing so that heat is not changed between both flat plate groups.

In the pump apparatus according to one embodiment of the present invention, if an overlapping portion is provided by overlapping edges of both flat plate groups along the flow direction, in the overlapping portion, each temperature affect each other, and the temperature of each flat plate may become non-uniform. For example, in FIG. 2B, the temperature $T_C$ of the flat plate group C may rise at the overlapping portion, while the temperature $T_H$ of the flat plate group H may drop at the overlapping portion. Such a temperature gradient makes the thermal transpiration flow from the low-temperature side to the high-temperature side be generated, the flow direction becomes +X direction as same as the flow direction by the above described thermal edge flow. Therefore, even if the temperature gradient as described above occurs, it acts on a direction to enhance an effect of the pump apparatus.

In the pump apparatus according to one embodiment of the present invention, to generate a temperature gradient between the flat plate groups, only one of the flat plate groups is heated or cooled. Or, one of the flat plate groups may be heated, and the other of the flat plate groups may be cooled.

In the pump apparatus according to one embodiment of the present invention, it is preferable to set the interval between the flat plates adjacent to each other in the direction crossing the passage in the same flat plate group (the interval corresponds to the interval D' of FIG. 2B) within the range to several hundred from one-several hundredth of the mean free path of gaseous molecules in a working pressure of the pump apparatus (in the followings, this range is referred to as a recommended edge interval). However, the pump apparatus of the present invention can work and practically be used even if the interval of the flat plates is out of the recommended edge interval, and the terminology of the "recommended edge interval" does not exclude a setting of other flat plate interval. In brief, from the viewpoint of the behavior of the gaseous molecules to be introduced into the passage 4, it is sufficient that the interval D' between the flat plates in the same flat plate group is set in a region which can be considered to be substantially the same as the mean free path of the gas molecules.

In the pump apparatus according to one embodiment of the present invention, a plurality of the pump units are connected along the flow direction and the low-temperature flat plate group C and the high-temperature flat plate group H may be provided to each pump unit.

Other Embodiments

In the above-described embodiment, both of the low-temperature body and the high-temperature body are formed in a flat plate shape of which thickness is sufficiently small in comparison with the length thereof in the flow direction. However, the low-temperature body and the high-temperature body which make the thermal edge flow occur do not limited to such a flat plate shape. As descried above, to make thermal edge flow occur, it is sufficient that a body to be a solid boundary exists in the gas, and when gaseous molecules which arrive at some point on the solid boundary (assumed as the point A) are considered, there is a difference between the average speed of gaseous molecules flying from one side of the plane including the point A and perpendicular to the surface (a wall surface) of the body and the average speed of gaseous molecules flying from the other side thereof. As far as such condition is satisfied, the low-temperature body and the high-temperature body may be formed in a various shape. In the followings, the other embodiments in which the low-temperature body or the high-temperature body are varied will be described.

Figure 3A:
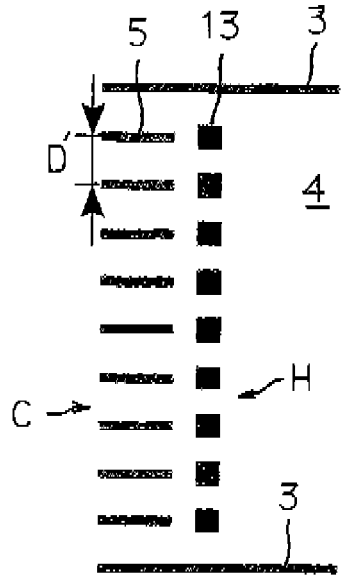
FIG. 3A is a view showing a pump apparatus of the second embodiment in which the high-temperature portion is changed.

FIG. 3A show the second embodiment in which, instead of the flat plates 6 on the high-temperature side of FIG. 2A, the high-temperature portion H is constructed by arranging the high-temperature bodies 13 of a column shape having a generally square cross section in the direction crossing the passage 4 with constant intervals D'. In this embodiment, the high-temperature bodies 13 of the same number as that of the flat plates 5 in the low-temperature flat plate group C are provided, and the flat plates 5 and the high-temperature bodies 13 are linearly arranged along the flow direction. The flat plates 5 and the high-temperature bodies 13 do not contact each other, and heat insulating layers by gas exist between them.

Figure 3B:
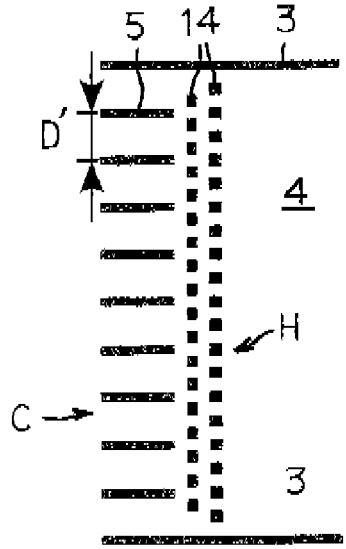
FIG. 3B is a view showing a pump apparatus of the third embodiment in which the high-temperature portion is further changed.

FIG. 3B shows the third embodiment in which, instead of the high-temperature bodies 13 of FIG. 3A, the high-temperature portion H is constructed by arranging the high-temperature bodies 14 of a column shape having a smaller section size along the direction crossing the passage 4. A plurality of lines (in the example of figure, two lines) of the high-temperature bodies 14 are provided in the flow direction, the high-temperature bodies 14 on each line are alternately shifted along the direction crossing the passage 4. Intervals of the high-temperature bodies 14 on each line are smaller than those of the flat plates 5 on the low-temperature side. The flat plates 5 and the high-temperature bodies 14 do not contact each other and the heat insulating layers by gas exist between them.

Figure 3C:
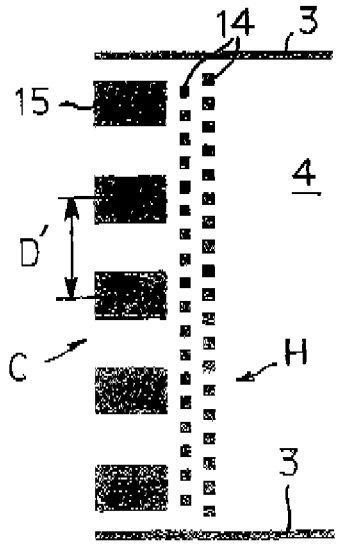
FIG. 3C is a view showing a pump apparatus of the fourth embodiment in which the low-temperature portion is changed.
Figure 3D:
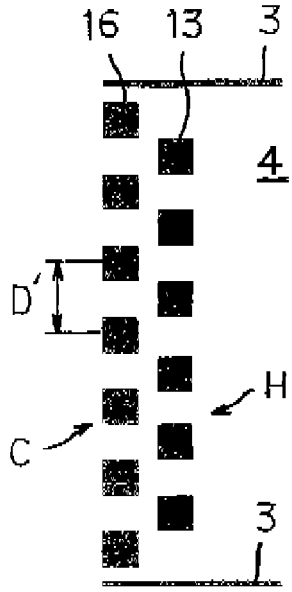
FIG. 3D is a view showing a pump apparatus of the fifth embodiment in which the low-temperature portion is further changed.

FIG. 3C shows the fourth embodiment in which, instead of the flat plates 5 in the low-temperature flat plate group C of FIG. 3B, the low-temperature portion C is constructed by arranging the low-temperature bodies 15 of a column shape having a rectangular cross section with enough thickness along the direction crossing the passage 4. The intervals (pitches) between the low-temperature bodies 15 are equal to the interval D' of the flat plates of FIG. 2A, and the heat insulating layers exist between the low-temperature bodies 15 and the high-temperature bodies 14.

FIG. 5D shows the fifth embodiment in which, instead of the flat plates 5 in the low-temperature flat plate group C of FIG. 3A, the low-temperature portion C is constructed by arranging the low-temperature bodies 16 of a column shape having a substantially square cross section with constant interval D' in the direction crossing the passage 4. In this embodiment, the low-temperature bodies 16 and the high-temperature bodies 13 are alternately arranged with respect to the direction crossing passage 4. The low-temperature bodies 16 and the high-temperature bodies 13 do not contact each other and the heat insulating layers by gas exist between them.

Figure 3E:
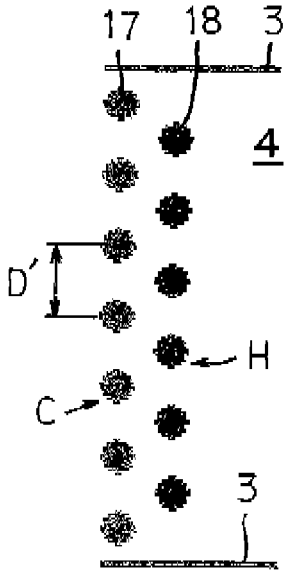
FIG. 3E is a view showing a pump apparatus of the sixth embodiment in which cylindrical bodies are provided to each of the low-temperature portion and the high-temperature portion.
Figure 4:
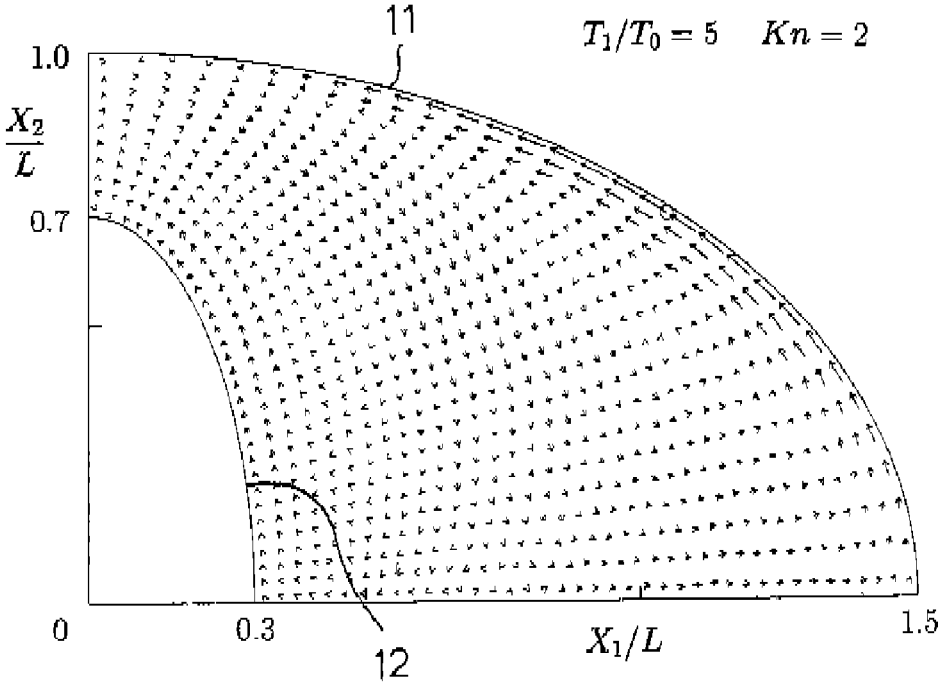
FIG. 4 is a view showing a simulation result of a flow in another embodiment of the thermal edge flow.

In the above, it is described that wall faces (surfaces) of the low-temperature bodies and the high-temperature bodies linearly extend in the flow direction, and they have sharp edges in the vicinity portion of the low-temperature bodies and the high-temperature bodies. However, it can be considered that the meaning of an edge capable of generating the thermal edge flow is extended to the radius of curvature which is less than the mean free path of gaseous molecules. For example, as show in FIG. 4, in the case in which inside of elliptic pipe 11 having constant temperature $T_0$, an elliptic cylinder 12 having constant temperature $T_1$ ($T_1>T_0$) is placed, flow occurs in the vicinity of inner wall surface of the elliptic pipe 11. In this way, even the circumference of the body that is not regarded as an edge at a glance, it is possible to generate the flow of gas caused by the same principle as the thermal edge flow. Therefore, even when the low-temperature bodies or the high-temperature bodies have limited curvature at the edges of the vicinity of those, the pump apparatus utilizing the thermal edge flow can be constructed. FIG. 3E shows the sixth embodiment as an example. In the embodiment of FIG. 3E, the low-temperature bodies 17 and the high-temperature bodies 18 having a cylindrical shape (circular cross section) are arranged in the same way as the embodiment of FIG. 2A. It is sufficient that the radius of curvature of each of the bodies 17 and 18 is less than the mean free path of gaseous molecules. In the embodiment shown in FIGS. 3A-3C, the configurations of the low-temperature portion C and the high-temperature portion H may be replaced with each other. That is, in FIG. 3A and FIG. 3B, the high-temperature portion H may be constructed by the flat plate group, and the low-temperature portion C may be constructed by the low-temperature bodies of a column shape, and in FIG. 3C, the high-temperature bodies in the high-temperature portion H may be formed in a column shape having a large cross section and the low-temperature bodies in the low-temperature portion C may be formed in a column shape having a small cross section.

Figure 3F:
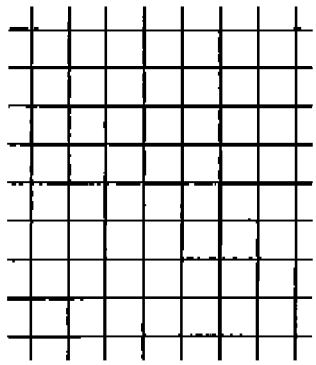
FIG. 3F is a view showing an example in which the low-temperature portion or the high-temperature portion is constructed as a wiring shape or grid shape.
Figure 3G:
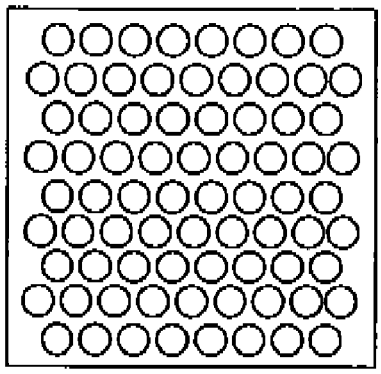
FIG. 3G is a view showing an example in which the low-temperature portion or the high-temperature portion is constructed by porous material.

In the embodiments shown above, to simplify, sectional views of two-dimension of the low-temperature portion and the high-temperature portion are shown, however, actually, in the direction perpendicular to the page, the low-temperature portion and the high-temperature portion may be constructed in a three-dimensional shape having the same cross section. In this case, wiring or net combined to make a grid or the like as shown in FIG. 3F, or as shown in FIG. 3G, the low-temperature portion or the high-temperature portion may be constructed by a porous material. In other, the low-temperature portion or the high-temperature portion may be constructed by combining the low-temperature bodies or the high-temperature bodies so as to form various kinds of shapes such as honeycomb shape, or by curving the surfaces of those bodies in a corrugated sheet shape. In any case, the wall portions which divides the passage in the pump into minute passages having width of the mean free path serve as the low-temperature bodies or the high-temperature bodies.

EXAMPLES

Figure 5:
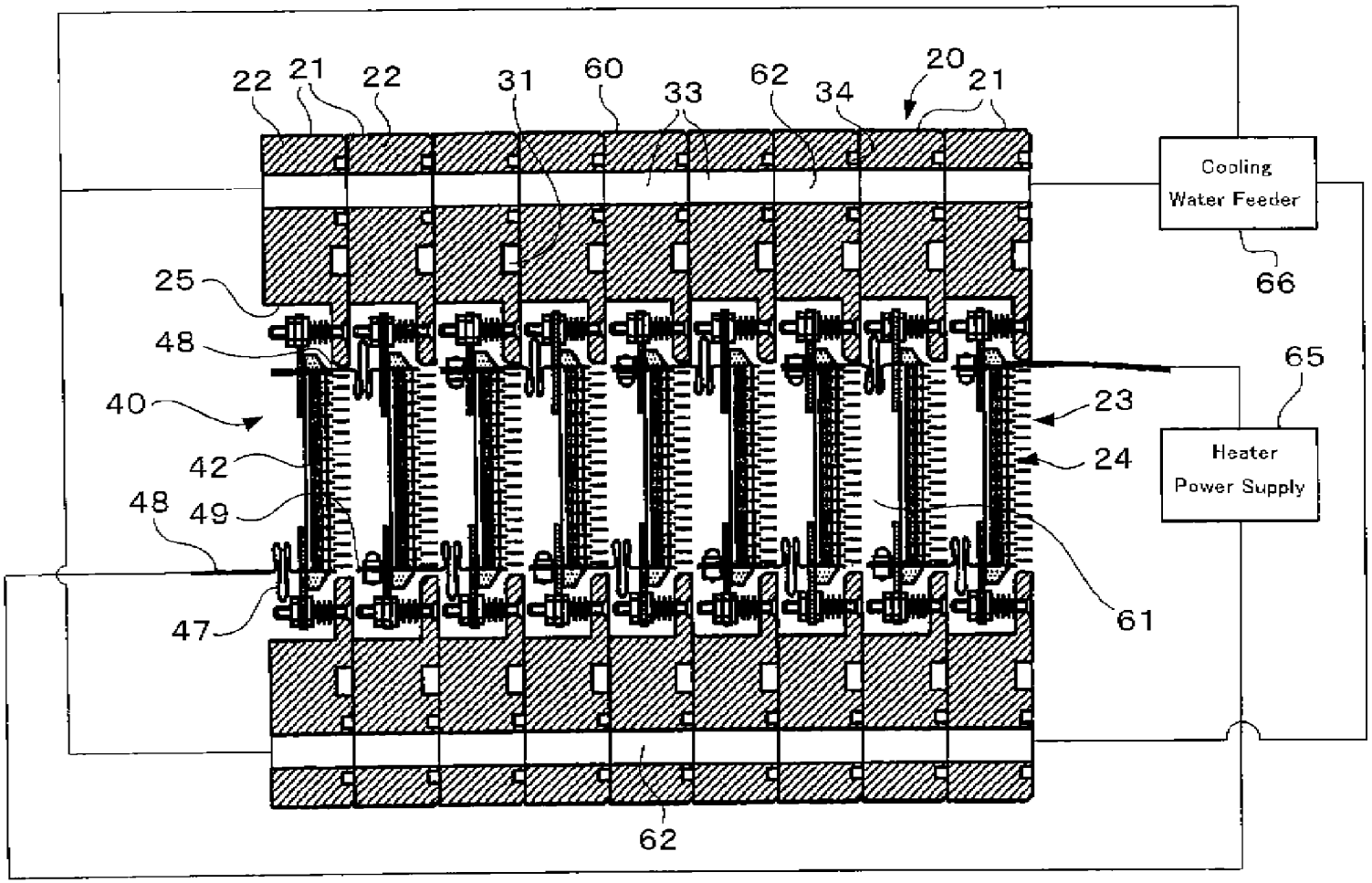
FIG. 5 is a sectional view in a direction of flow in an example of the pump apparatus according to the present invention.
Figure 6:
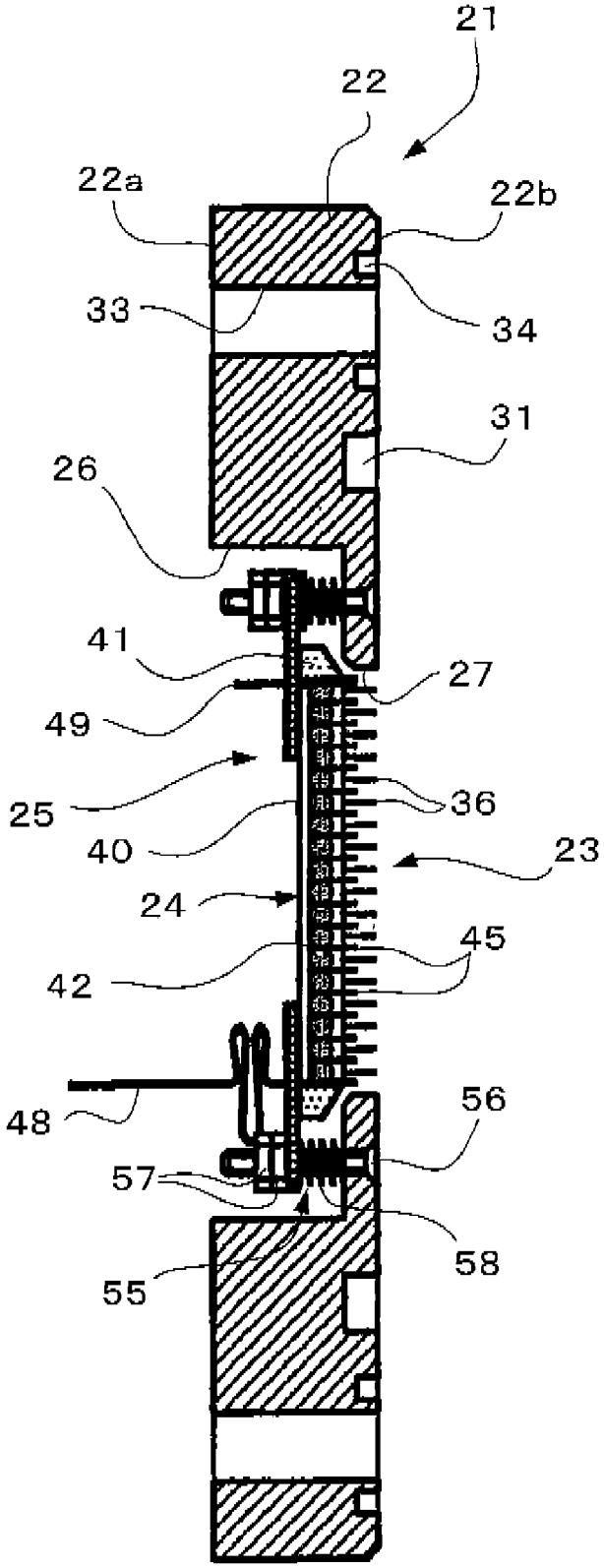
FIG. 6 is a sectional view of a pump unit used in the pump apparatus of FIG. 5.
Figure 7:
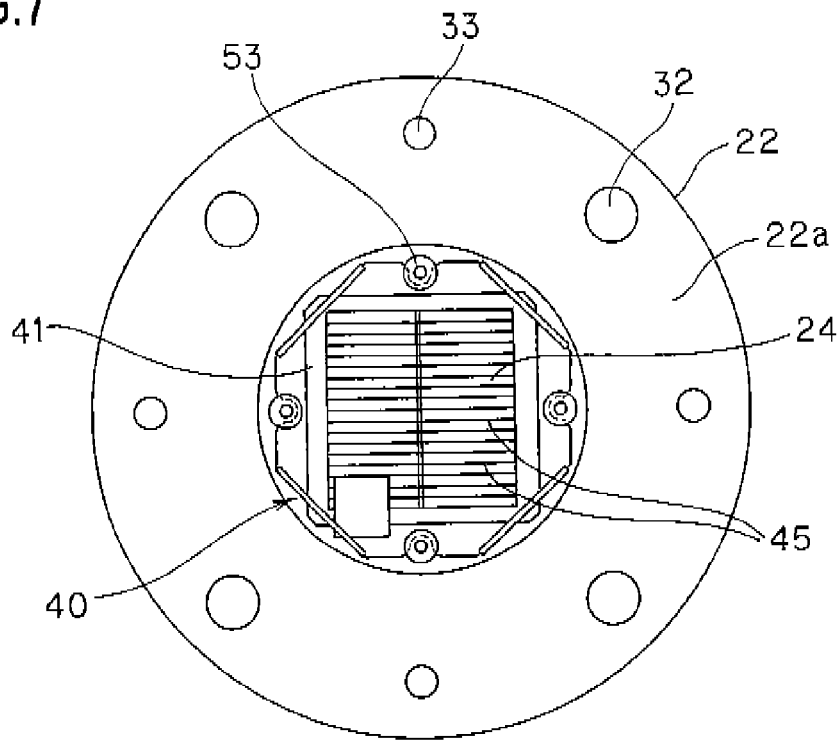
FIG. 7 is a left side view of the pump unit of FIG. 6.
Figure 8:
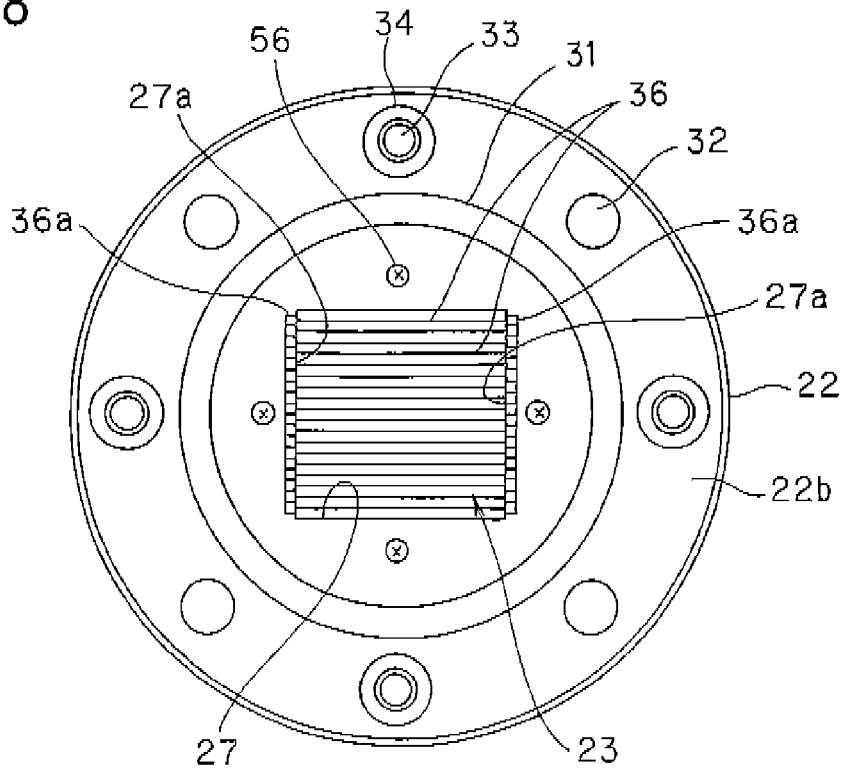
FIG. 8 is a right side view of the pump unit of FIG. 6.

Next, referring to FIGS. 5-14C, further concrete examples according to the present invention will be described. FIG. 5 is a sectional view along the flow direction of the vacuum pump according to one example of the present invention. The pump 20 has a plurality of (nine in the figure) pump units 21 successively arranged in the flow direction of gas. FIG. 6 is a sectional view along the flow direction of each pump unit 21, FIG. 7 is a side view from the left of the FIG. 6, FIG. 8 is a side view from the right of FIG. 6. As show in FIGS. 6-8, a pump unit 21 has a disk shape flange 22, and a low-temperature flat plate group (a low-temperature portion) 23 and a high-temperature flat plate group (high-temperature portion) 24 attached to the flange 22.

Figure 9A:
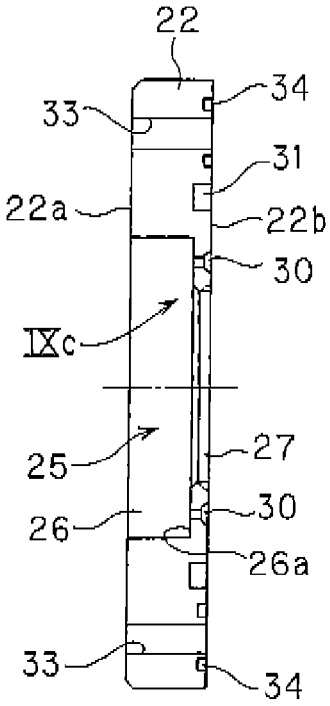
FIG. 9A is an axis direction sectional view of a flange used for the pump unit of FIG. 6.
Figure 9B:
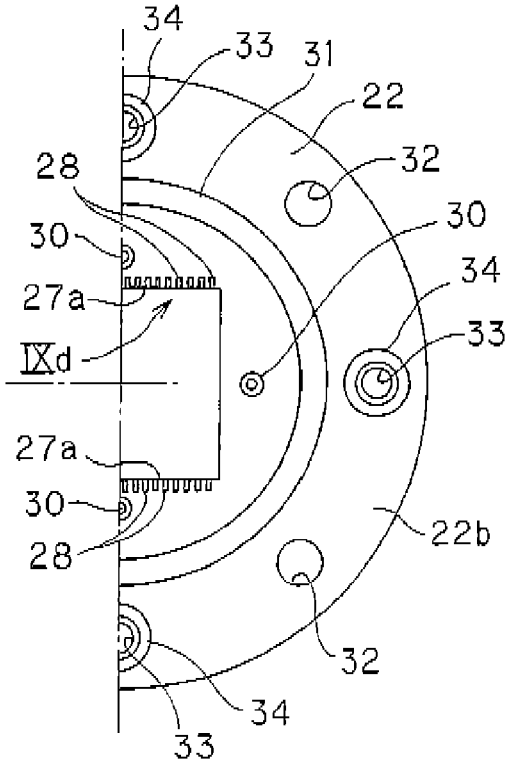
FIG. 9B is a side view of the flange of FIG. 9A.
Figure 9C:
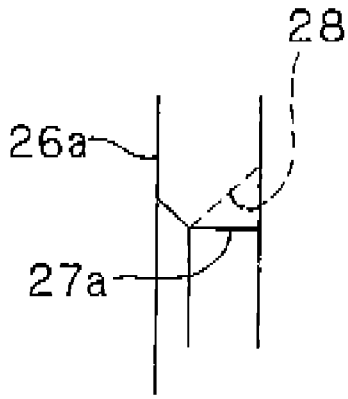
FIG. 9C is an extended view of the IXc portion of FIG. 9A.
Figure 9D:
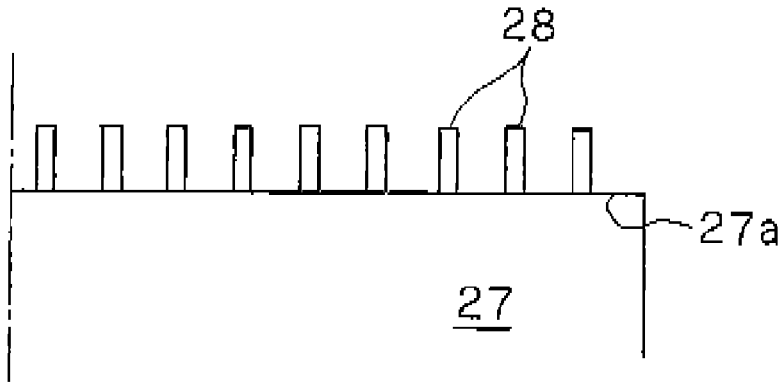
FIG. 9D is an extended view of the IXd portion of FIG. 9B.

The flange 22 serves as a housing constructing an external wall of the vacuum pump 20. The flange 22 can be obtained, for example, by carrying out a required additionally processing to the material of a flange for piping parts to which the vacuum pump 20 is attached. FIG. 9A and FIG. 9B show an example of the flange 22, FIG. 9A is a sectional view in an axis direction, FIG. 9B is a right side view (however, only a semicircle part is shown). FIG. 9C is an extended view of the IXc portion shown in FIG. 9A, and FIG. 9D is an extended view of the IXd portion shown in FIG. 9B. As show in these figures, there is provided a hollow portion 25 penetrating the flange 22 in the axis direction at the center of the flange 22. The follow portion 25 comprises a recess 26 opening to one end 22*a* of the flange 22, and trough hole 27 penetrating between the bottom face 26*a* of the recess 26 and the other end 22*b* of the flange 22. The through hole 27 is an angular hole forming a rectangular shape when it is viewed from the axis direction of the flange 22, and on the edges of a pair of opposing inner faces 27*a* on the side of the end face 22*a*, there are provided fin mounting grooves 28 with constant intervals (refer to FIGS. 9C and 9D). The number of the fin mounting grooves 28 on each edge is the same, and the fin mounting grooves 28 of one edge are located on the extended lines of the fin mounting grooves 28 on the other edge so as to be pairs. As show in FIG. 9A and FIG. 9B, in a periphery of the through hole 27, screw through holes 30 penetrating between the flange end face 22*b* and the bottom face 26*a* of the recess 26 are provided, and on the outside, a seal-groove 31 opening to the flange end face 22*b* is provided. Further, on the outside of the seal-groove 31, bolt through holes 32 penetrating the flange 22 along the axis direction are provided at constant pitches in a circumferential direction, and between the bolt through holes 32, water through holes (refrigerant passages) 33 to let cooling water as a coolant are provided so as to penetrate the flange 22 along the axis direction. A seal-groove 34 is provided at the lip of each water through hole 33 on the side of the end face 22*b*.

To the fin mounting grooves 28 of the flange 22, as shown in FIG. 8, edges 36*a* of cooling fins (corresponding to the flat plates on the low-temperature side) 36 constructing the low-temperature flat plate group 23 are fixed. That is, by bridging a cooling fin 36 between the fin mounting grooves 28 in a pair on the edges of the through hole 27, a plurality of cooling fins 36 are provided in the through hole 27 in parallel to each other with constant intervals, and therefore, the low-temperature flat plate group 23 is constructed in the through hole 27. Each cooling fin 36 is formed in a material having superior heat conduction characteristics, as an example, thin plate of alumina can be used as the material of the cooling fin 36. The cooling fins 36 may be fixed to the flange 22 by utilizing various kinds of fixed means, as an example, an alumina-base bonding agent can be used. Intervals D' between the cooling fins 36 can be set to the recommended edge interval to be determined corresponding to the pressure which the vacuum pump 20 is used. Within the recommended edge interval, it is further preferable that the interval D' is especially set in a range from several ten times to one-several tenth of the mean free path.

Figure 10:
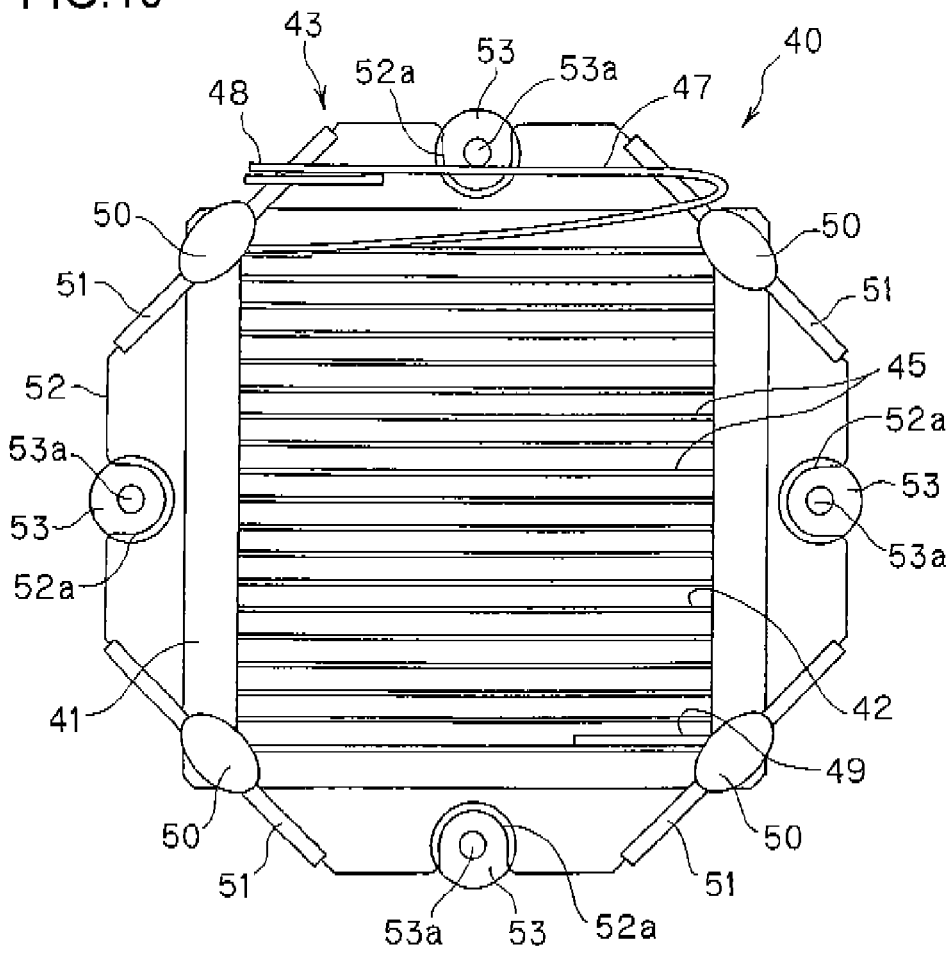
FIG. 10 is a front view of the heater unit used for the pump unit.
Figure 11:
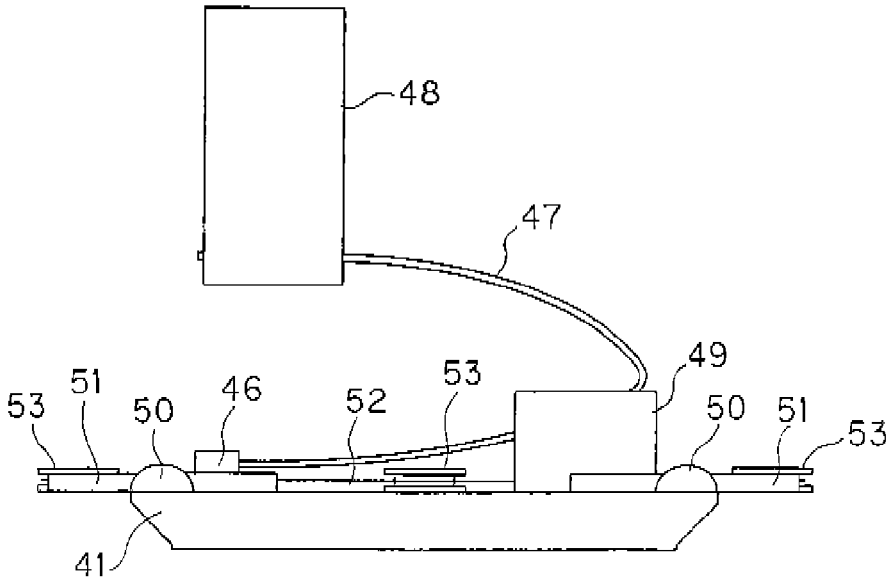
FIG. 11 is a bottom view of the heater unit of FIG. 10.

On the other hand, a heater unit 40 is arranged in the recess 26 of the flange 22. The heater unit 40 includes the high-temperature flat plate group 24, and it serves as means for operating temperature of the high-temperature flat plate group 24. FIG. 10 is a front view of the heater unit 40 and FIG. 11 is a side view thereof. The heater unit 40 has a frame 41, and a heating element 42 held by the frame 41 and a support mechanism 43 for supporting the frame 41.

Figure 12A:
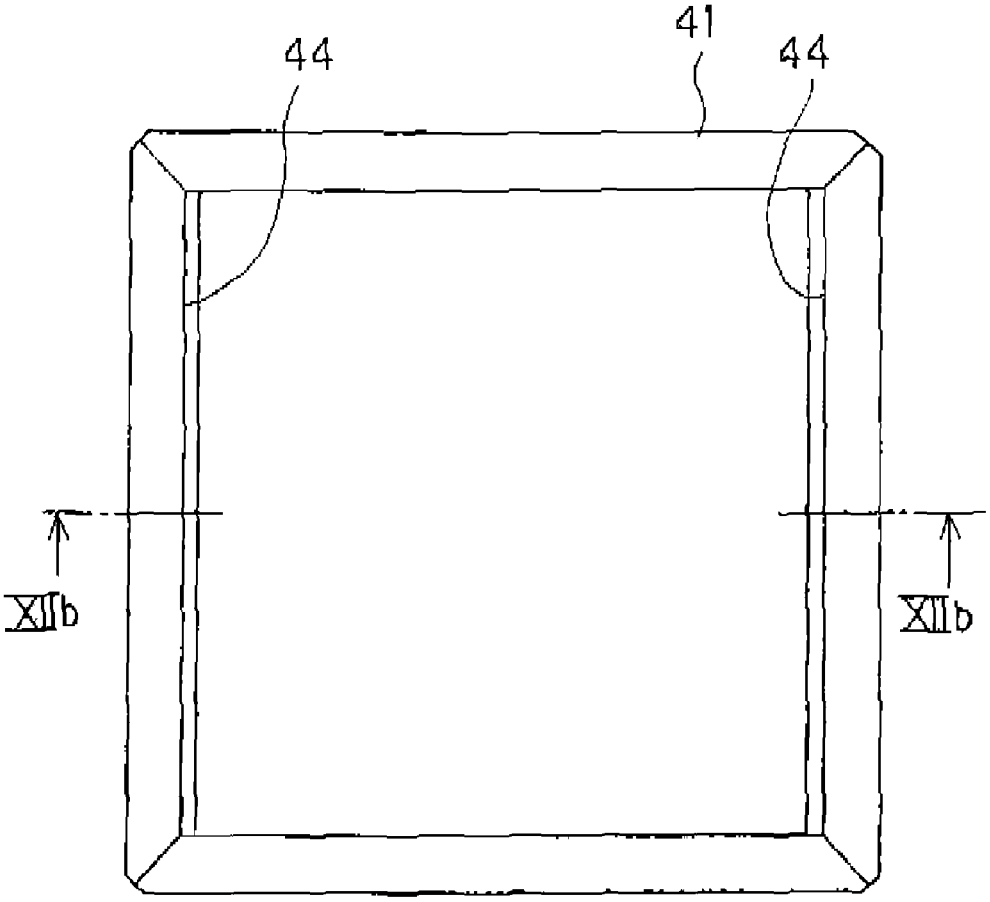
FIG. 12A is a front view of a frame used for the heater unit of FIG. 10.
Figure 12B:
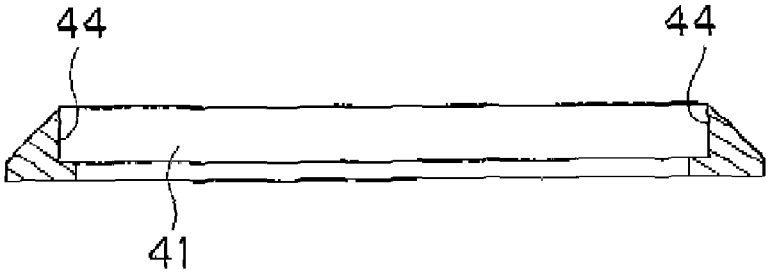
FIG. 12B is a sectional view along the XIIb-XIIb line of FIG. 12A.

As show in FIG. 12A and FIG. 12B, the frame 41 is formed in a rectangular shape and accommodation grooves 44 are provided on a pair of mutually parallel inside surfaces. It is desirable that the frame 41 is made by a material having excellent thermal conduction to make the heat of the heating element 42 uniform, as an example, alumina can be used as the material of the frame 41.

Figure 13A:
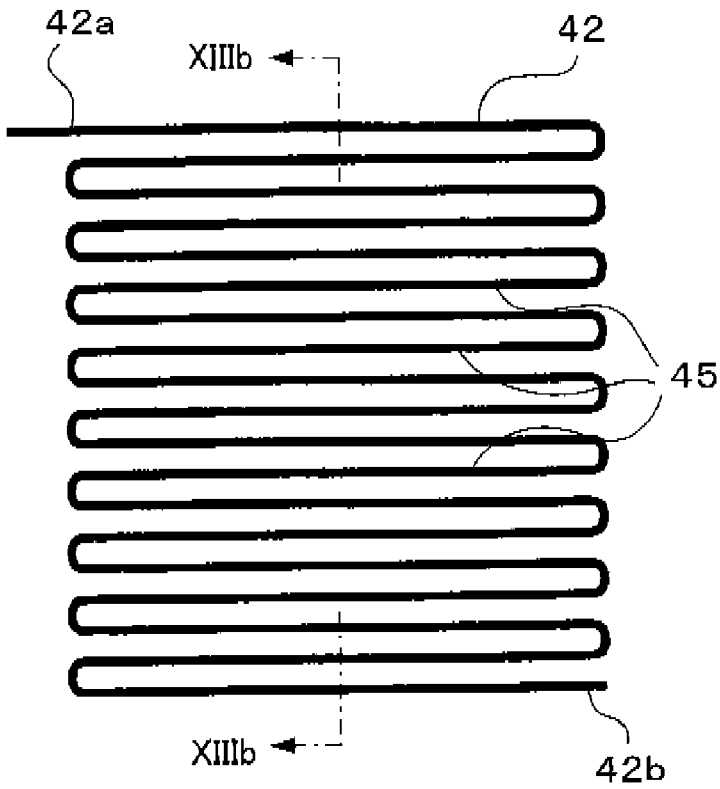
FIG. 13A is a front view of a heating element used for the heater unit.
Figure 13B:
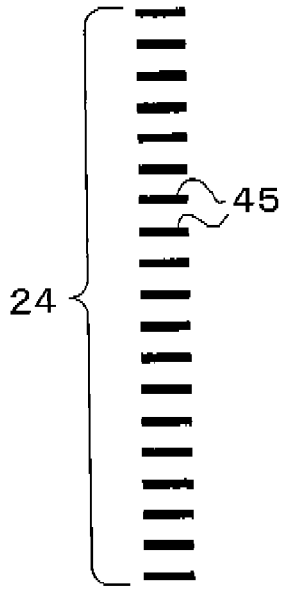
FIG. 13B is a sectional view along the XIIIb-XIIIb line of FIG. 13A.
Figure 13C:
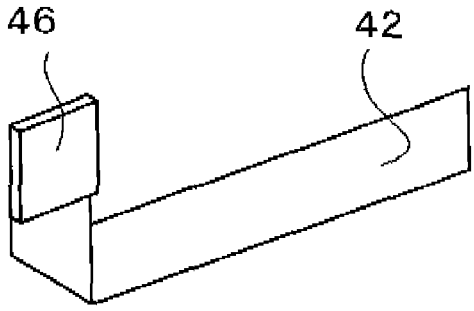
FIG. 13C is the figure which shows bending of an edge of the heating element.

On the other hand, as shown in FIG. 13A and FIG. 13B, the heating element 42 is formed by folding a belt-shaped heating wiring material made by a material having large electric resistance, such as nichrome, into an accordion shape with constant pitches, and by applying an electric current between edges 42*a* and 42*b*, heat can be generated entirely. Therefore, the regions which are linearly extend between the folded portions of the heating element 42 serve as heating fins 45, and an aggregation of these heating fins 45 constitutes the high-temperature flat plate group 24. Intervals of the heating fins 45 accord with the intervals of the cooling fins 36. One edge 42*a* of the heating element 42 is extended outwardly from the heating fin 45, and as show in FIG. 13C, the extended portion is bent about 90° to form a terminal portion 46.

Figure 14A:
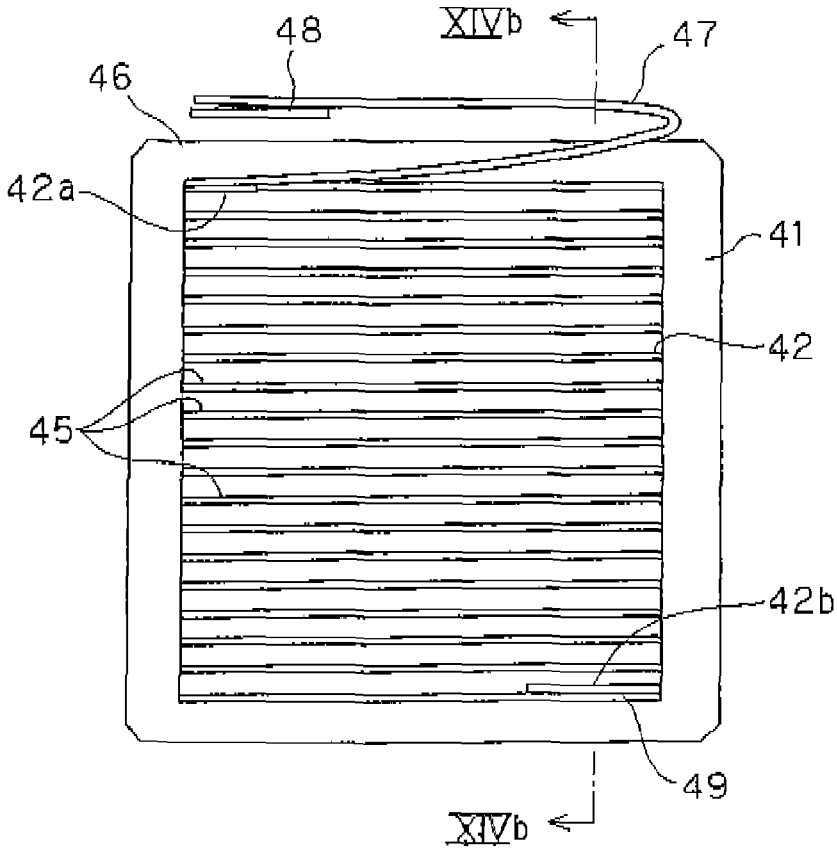
FIG. 14A is the front view of a sub-assembly of the heater unit.
Figure 14B:
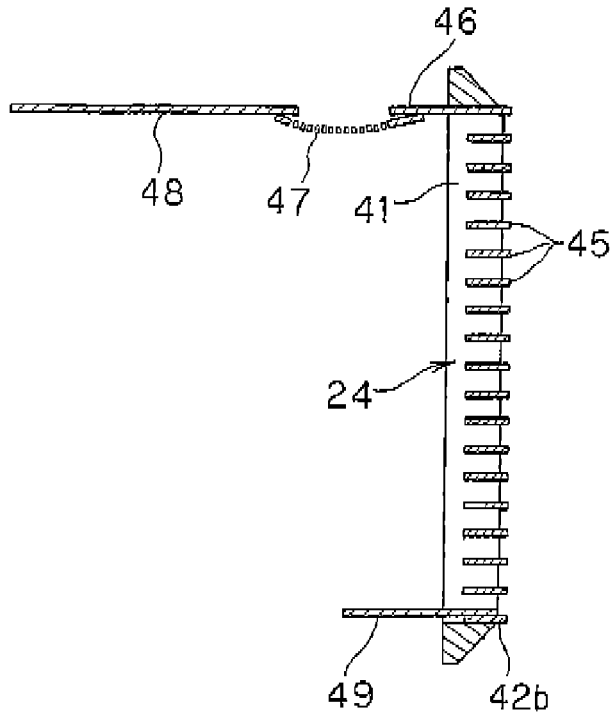
FIG. 14B is a sectional view along the XIV b-XIV b line of FIG. 14A.
Figure 14C:
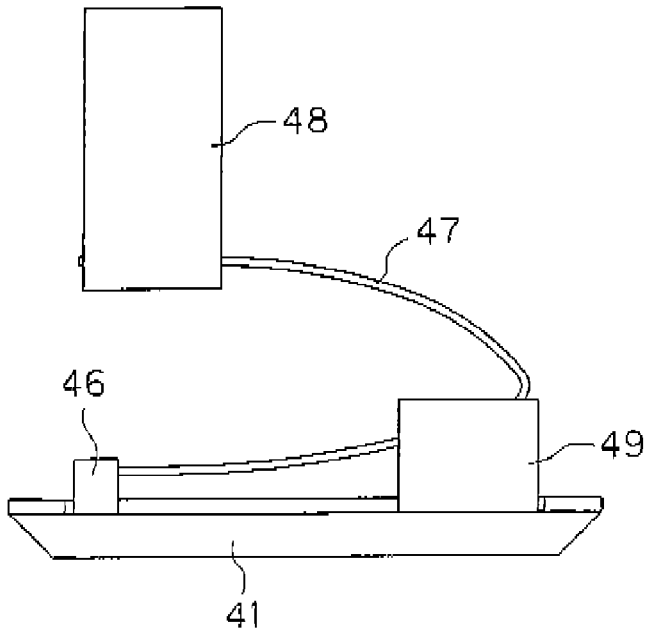
FIG. 14C is a bottom view of the sub-assembly of the heater unit.

The heating element 42 constituted as above is attached to the frame 41, as shown in FIGS. 14A-14C, so as to make the folded portion be conformed to the accommodation grooves 44 of the frame 41. Further, the heating element 42 attached to the frame 41 is fixed to the frame 41 by suitable fixed means, for example, alumina-base-bonding-agent. An electrode plate 48 is connected to the terminal portion 46 of the heating element 42 fixed to the frame 41 through a conducting wiring 47 by utilizing fixed means such as welding. For example, a stainless wiring is used for the conducting wiring 47. On the other hand, to the edge 42*b* on the opposite side of the heating element 42, an electrode plate 49 is connected by utilizing fixed means such as welding.

Return to FIG. 10 and FIG. 11, the support mechanism 43 of the heater unit 40 has pipe-like heat insulation members 51 connected to the four corners of the frame 41 through adhesive layers 50, a wire 52 provided to connect the insulation members 51, and supporting rings 53 provided near an intermediate position of each side of the frame 41. Zirconia, for example, is used for the insulation members 51. The wire 52 is formed to draw a closed shape of generally octagonal shape as a whole by being passed through inside of each insulation member 51 and by jointing both ends with each other. The supporting rings 53 are fit to bending portions 52*a* of the wire 52 to thereby be connected to the wire 52. Through holes 53*a* are formed in the centers of the supporting rings 53.

The heater unit 40 constituted as above is accommodated to the recess 26 so that the electrode plates 48 and 49 project from the recess 26 as shown in FIG. 6 to FIG. 8, and is attached to the flange 22 by a floating mechanism 55. The floating mechanism 55 serves as connecting means for supporting the heater unit 40 at a plurality of points, and countersunk head screws 56 which are mounted from the side of the end face 22*b* to the screw through holes 30 (refer to FIG. 9A and FIG. 9B) and the tips thereof are passed into the through holes 53*a* (refer to FIG. 10) of the supporting rings 53 of the heater unit 40, pairs of nuts 57 to which the countersunk head screws 56 projected from the supporting rings 53 are screwed into, and coil springs 53 arranged between the bottom face 26*a* of the recess 26 and the supporting rings 53. Each pair of nuts 57 serves as means for adjusting the gap between the bottom face 26*a* and the supporting rings 53 so that the coil springs 58 are compressed only appropriate quantity less than the maximum amount of compression.

By the floating mechanism 55 as above-described, the heater unit 40 is connected to the flange 22 so that the heater unit 40 can slightly move along the axis direction of the flange 22. By biasing to the direction in which the supporting rings 53 escape to the side of the end face 22*a* from the recess portion 26 due to the compression reaction force of the coil springs 58, in other words, the direction in which the heating fins 45 are separated from the cooling fins 36, the heater unit 40 is supported in the state floated from the flange 22, except the contact portions at which the supporting rings 53 contact the nuts 57 and the coil springs 58. Thereby, heat conduction between the heater unit 40 and the flange 22 is sufficiently restrained. Further, in the heater unit 40, since the supporting rings 53 and the frame 41 are connected by the insulation members 51 and the wire 52, the heat conduction between the frame 41 and the supporting rings 53 is also sufficiently restrained. By these synergistic effects, the thermal insulation performance between the heating fins 45 and the flange 22 becomes extremely high, the heating fins 45 of the heater unit 40 can be held in a desired high-temperature range with a little energy. In the embodiment as above-described, an insulating portion is constituted by the insulation members 51, the wire 52, the supporting rings 53 and the floating mechanism 55.

As it is apparent from FIG. 6, the heater unit 40 is attached to the flange 22 in the same manner as that shown in FIG. 2A, that is, so that the heating fins 45 and the cooling fins 36 are arranged alternately with constant intervals with respect to the aligned direction of each fin, and with respect to the axis direction of the flange 22, edges of the heating fins 45 and the cooling fins 36 are overlapped only in the determined length. An interval between the adjacent heating fin 45 and the cooling fin 36 is set, as the same as the interval D' of FIG. 2A, to the recommended edge interval to be decided depending on the pressure in which vacuum pump 20 is used for.

Return to FIG. 5, the vacuum pump 20 is constituted by joining a plurality of pump units 21 so as to be aligned in the axis direction of the flanges 22 and be alternately turned by 180° in the radius direction. The joining is realized by mounting through bolts into the bolt through holes 32 of the flanges 22 and screwing them into the nuts on the opposite side. By joining the pump units 21, the flange 22 are connected in series to thereby form a pipe-like pump housing 60, and the hollow portions 25 of the flanges 22 are connected in series so that the inner flow path 61 of the vacuum pump 20 is formed. The both ends of the pump housing 60 are connected to pipe passages to which the vacuum pump 20 is applied.

To keep an air tightness of the inner flow path 61, a ring-like seal member (not shown) is attached to the seal groove 31 of each flange 22, and a joint between the flanges 22 is sealed by it. The water through holes 33 are connected in series by joining the flanges 22 to thereby form a cooling water passage 62 in the pump housing 60. To prevent water leak from the cooling water passage 62, seal members (not shown) are attached to the seal grooves 34. Further, by joining the flanges 22 each other, the electrode plate 48 of each pump unit 21 comes in contact with the electrode plate 49 of the adjacent pump unit 21. Thereby, the heating element 42 of each heater unit 40 is connected in series. The electrode plate 48 of the pump unit 21 arranged at one end of the pump 20 and the electrode plate 49 arranged at the opposite end of the pump unit 21 are connected to the heater power supply 65. In addition, the cooling passage 62 is connected to the cooling water feeder 66.

According to the vacuum pump 20 as above-described, each housing 22 is cooled by leading the cooling water to the cooling water passage 62 from the cooling water feeder 66, and cooling the cooling fins 36 fixed to the housings 22, while the heating fins 45 are heated by sending an electric current to the heating elements 42 from the heater power supply 65, then enough temperature gradient between the low-temperature flat plate groups 23 and the high-temperature flat plate groups 24 can be generated. Therefore, by decompressing the exhaust side of the inner flow path 61 in the housing 60 (left end side in FIG. 5) to the working pressure region of the pump 20, it is possible to generate the thermal edge flow directing to the high-temperature side between the cooling fins 36 and the heating fins 45 of each pump unit 21, thereby, as a whole, the flow of gas from the right to the left in FIG. 5 can be induced.

In the above-described example, means for heating the flat plate group 24 is constructed by the heater unit 40 and the heater power supply 65, means for cooling the flat plate group 23 is constructed by the cooling passage 62 and the cooling water feeder 66. Both of these means construct means for operating temperature of the flat plate group. That is, in the above-described example, the high-temperature flat plate group 24 also serves as a part of means for operating temperature of the flat plate group.

The number of the pump units 21 may be chosen appropriately depending on the pressure difference required to the vacuum pump, optional number of one or more can be selectable. Depending on the temperature gradient to be generated between the flat plate group 23 on the low-temperature side and the flat plate group 24 on the high-temperature side, the cooling by the cooling water may be omitted. Even when the cooling is necessary, instead of the cooling by water, appropriate cooling system such as air cooling or the like can be applied. With respect to the heating of the flat plate group 24, it is not limited to the heat owing to the electric resistance, and various means can be used. In the above-described examples, the low-temperature bodies and the high-temperature bodies are formed like a flat plate, however, these can be changed to various shapes such as a column shape, a thick plate shape or a cylindrical shape.

Regarding Experiment Examples

Figure 15:
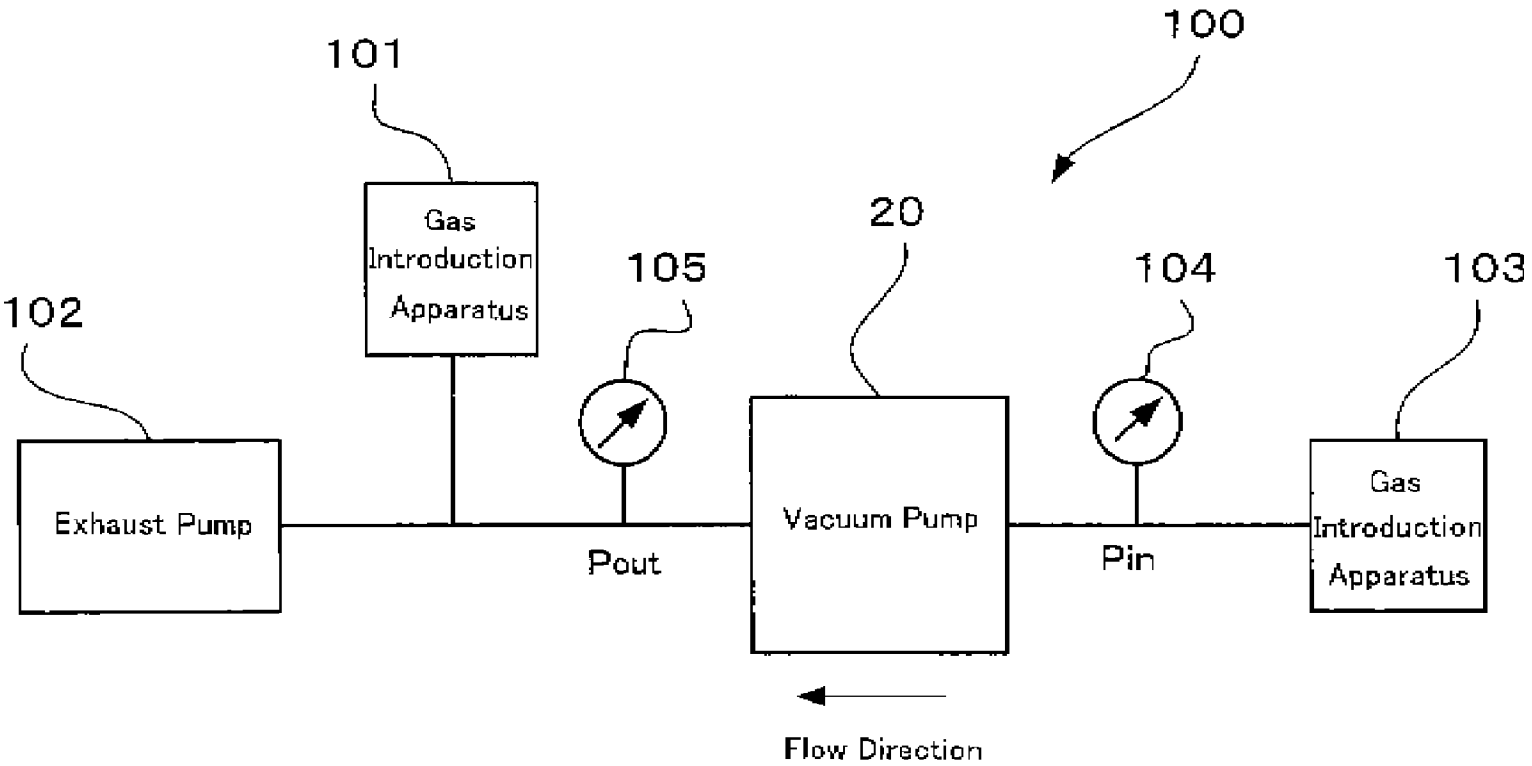
FIG. 15 is a view showing a schematic configuration of an experimental device.

Next, experiment examples will be described. The vacuum pump 20 of the example shown in FIG. 5 was really made, and the performance was confirmed by the test device 100 shown in FIG. 15. In the test device 100, a gas introduction apparatus 101 and a evacuation pump 102 (for example an oil-sealed rotary vacuum pump) are connected to an exhaust side (left side in the figure) of the vacuum pump 20, and the pressure of an exhaust port is made to be controllable, another gas introduction apparatus 103 is installed on an intake side, and flow rate (or a pressure of the intake port) of the gas flowing through inside of the vacuum pump 20 from the intake port thereof is made to be controllable. On the intake side and the exhaust side of the vacuum pump 20, pressure gauges 104 and 105 are installed. The number of the pump units 21 in the vacuum pump 20 is ten.

Figure 16A:
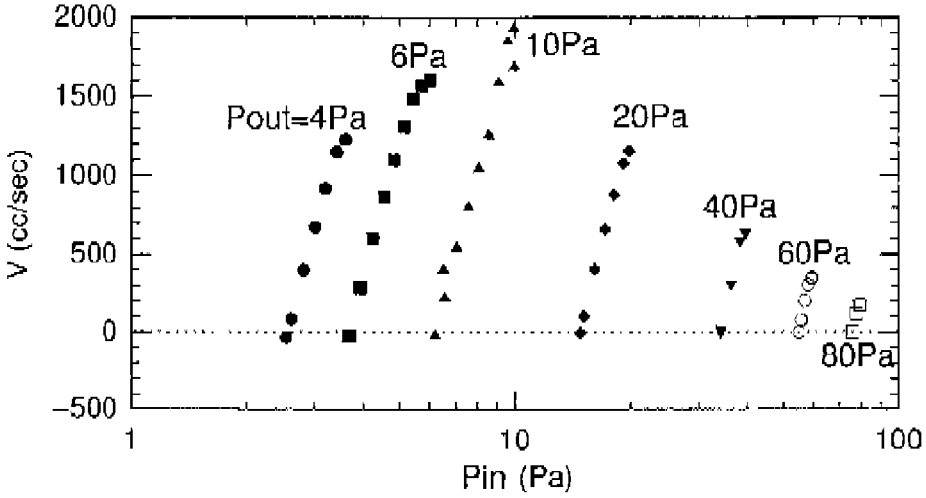
FIG. 16A is a view showing an experimental result.
Figure 16B:
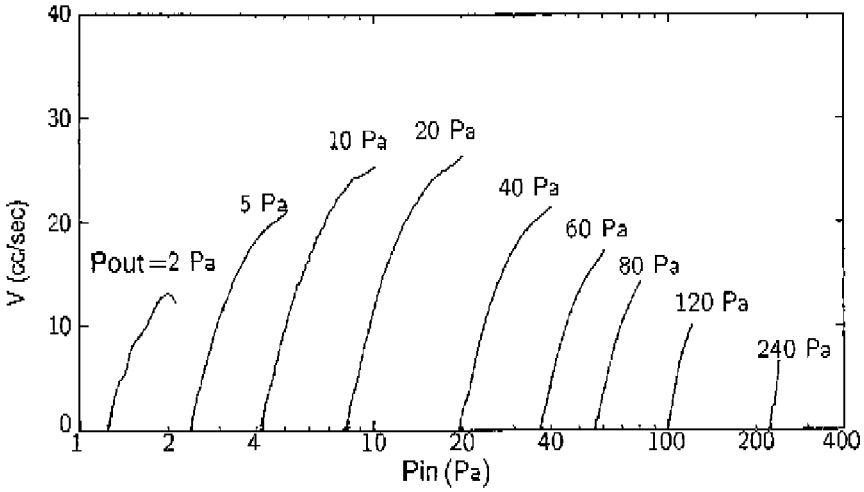
FIG. 16B is a view showing a comparison example.

In the above-described test device 100, the relation between the flow rate (V) of gas passed through the vacuum pump and the pressure (Pin) at the intake port was examined while keeping the pressure (Pout) of the exhaust port of the vacuum pump 20 constant, and its result is shown in FIG. 16A. FIG. 16B shows the result of similar experiment for the prior Knudsen compressor. The electric power consumption of the unit was about 100 watts in FIG. 16A and about 40 watts in FIG. 16A. From the comparison of both (for example, the flow rate comparison when both of Pout and Pin are 10 Pa), according to the vacuum pump of the present invention, it is understood that the flow rate of about 50 times was obtained with the consumption energy of 2 times. As for the energy efficiency, from the values of flow rates Pin and Pout (Pout<Pin), and the gas temperatures at the front and the back of the vacuum pump apparatus 20, the theoretical value of the thermodynamic energy required to compress the gas may be obtained, and the ratio to the consumption energy may be examined.

In the pressure difference Pout−Pin between the front and the back of the vacuum pump 20 and the consumption energy of the vacuum pump 20 measured in the test device 100, there are included the effects by decreasing of the momentum and the kinetic energy of gas during the passing of the gas through the vacuum pump 20. However, the percentage of these effects is about square of Mach number of the flow. Mach number in the vacuum pump 20 is sufficiently smaller than one. Therefore, it is thought that the measured pressure difference Pout−Pin and the consumption energy of the vacuum pump 20 express the performance of the vacuum pump 20.

Other Examples

The present invention is not limited to the above-described example, various kinds of variations are possible. In the following, other examples are described. In the following figures, the same reference numerals are used for the common parts with FIG. 2A.

Figure 17:
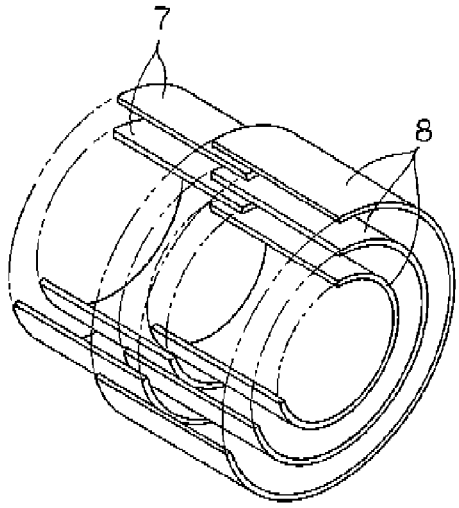
FIG. 17 is a view showing an example in which a group of flat plates is constructed by combining circular cylinder bodies.

In the present invention, the flat plate does not have to be uniformly flat in the entirety thereof. It is sufficient that the plate is formed in the shape of flat plate in the flow direction on the cross section along the passage. For example, as show in FIG. 17, even a configuration in which a plurality of circular cylindrical bodies 7 and 8 are combined coaxially and alternately along the radius direction, in the cross section of the axis direction, the same configuration as that of FIG. 2A is obtained. Such circular cylindrical bodies 7 and 8 are also included in the concept of the flat plates as the low-temperature bodies or the high-temperature bodies of the present invention.

Figure 18:
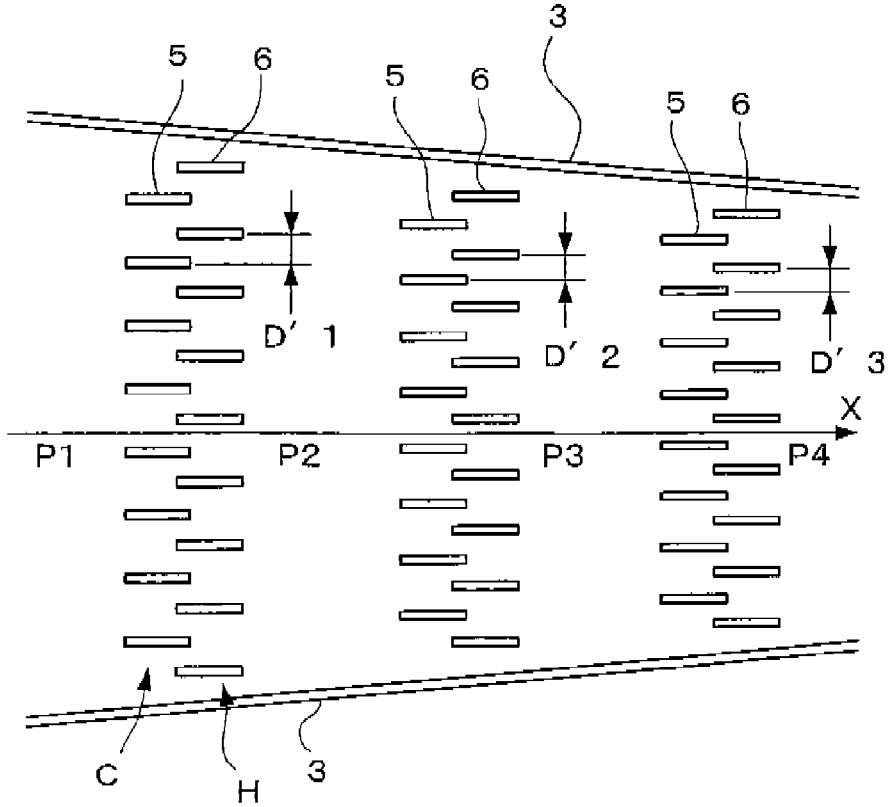
FIG. 18 is a view showing an example in which intervals of flat plates are changed along a flow direction.

In the embodiment of FIG. 5, intervals between the flat plates at each pump unit 21 are constant, however, considering that the pressure increases from the intake port to the exhaust part while the mean free path of the gaseous molecules decrease, the intervals between flat plates may be made to be smaller on the downstream side than on the upstream side in the flow direction. In an example of FIG. 18, since the pressure increases toward downstream side in the flow direction (arrow X direction) and the relation of P1<P2<P3<P4 is established, the intervals D'1-D'3 between each of the flat plates 5 and 6 in the flat plate groups C and H are changed in the inverse order of that of the pressures to thereby establish the relation of D'1-D'3.

Figure 19A:
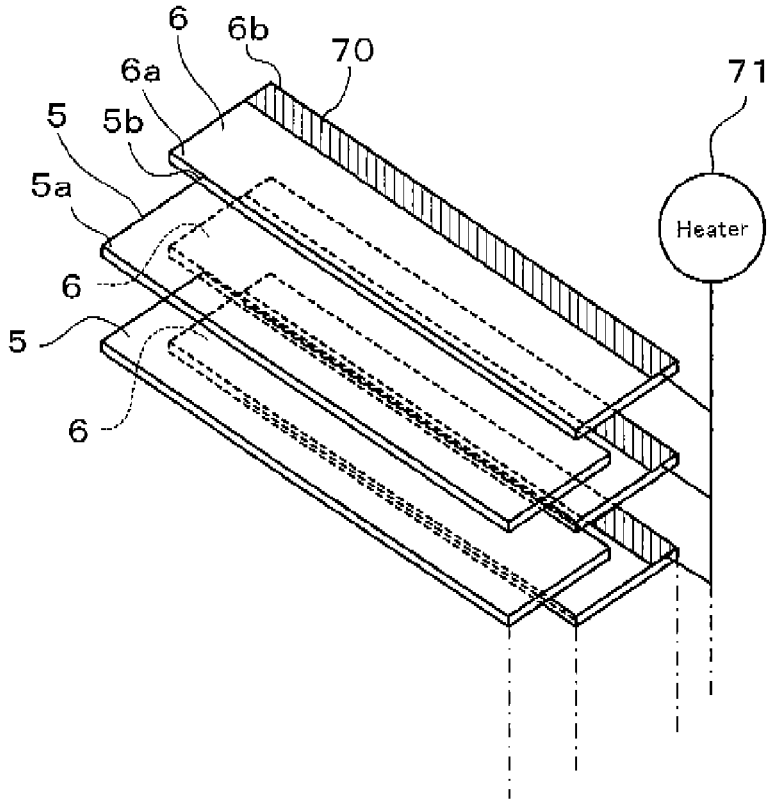
FIG. 19A is a perspective view showing an example in which a temperature gradient is generated on the same flat plate.

In the example of FIG. 5, the entirety of the heating fin 45 is made to generate heat uniformly, however, the temperature distribution on the flat plate may be operated so that the thermal transpiration flow of the same direction as that of the thermal edge flow is generated. One example of that is shown in FIG. 19A. In this example, the heat generating portions (hatched portions) 70 are provided only at the rear edge portions 6*b* of the flat plates 6 constructing the high-temperature side flat plate group H, and each heat generating portion 70 is connected to the heat source 71 to be heated. The heat generating portions 70 may be made of heating wire materials such as nichrome as same as the heating fins 45 of FIG. 5, and the heat source 71 may be an electric power supply.

Figure 19B:
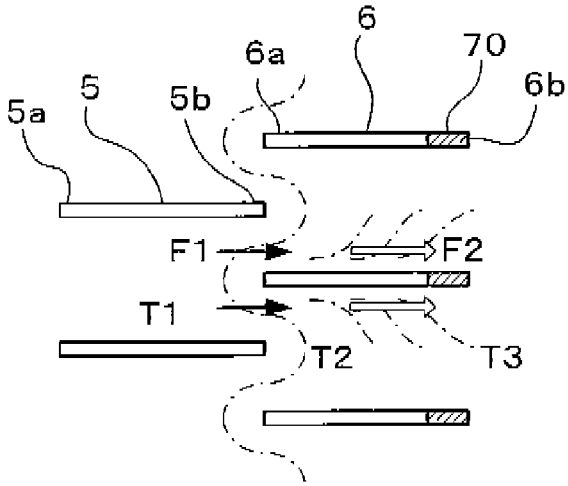
FIG. 19B is a sectional view along the flow direction of the example of FIG. 19A.

According to such a configuration, as shown in FIG. 19B by the chain lines, a temperature gradient (T1<T2) is generated between the flat plates 5 on the low-temperature side and the flat plates 6 on the high-temperature side, so that flow by the thermal edge flow is generated as shown by the arrow F, and even on the flat plates 6 on the high-temperature side, the temperature gradient (T2<T3) is generated, as shown by the arrow F2, so that flow by the thermal transpiration flow is further generated. Thereby, further improvement of the pump ability is expected.

Figure 20:
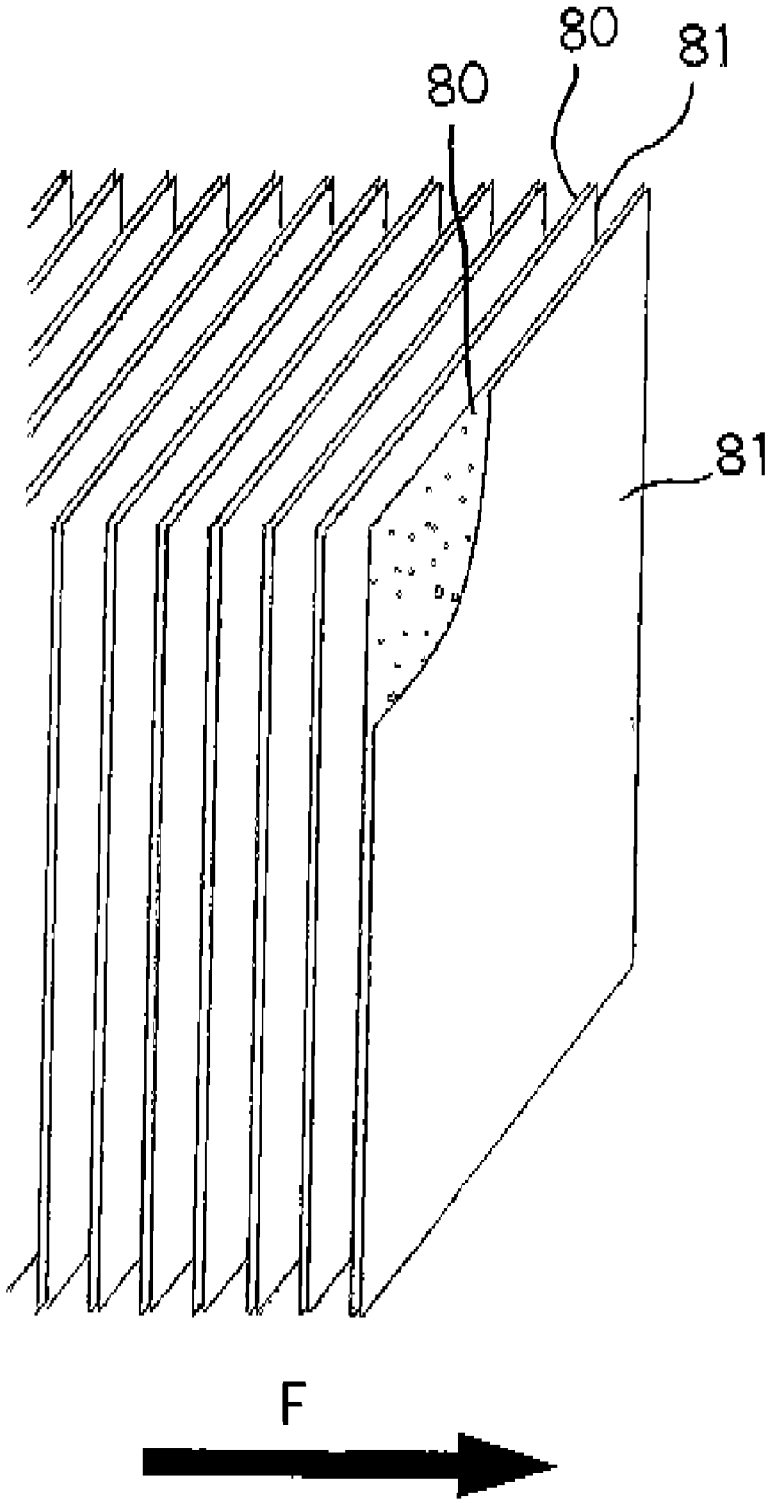
FIG. 20 is a partial perspective view showing another example of the pump apparatus according to the present invention.

FIG. 20 shows a further example. In the example, the first gas permeability sheets 80 as the low-temperature portion and the second gas permeability sheets 81 as the high-temperature portion are alternately arranged along the flow direction (arrow F direction). Each of the permeable sheets 80 and 81 has many minute holes (through holes) through which gaseous molecules can be passed, and walls surrounding those permeable holes serve as the low-temperature bodies or the high-temperature bodies. A pair of permeable sheets 80 and 81 are faced each other through a minute gas layer (a heat insulating layer) by inserting spacers or bonding-materials (not shown) at appropriate points. The spacers or the bonding-materials are constituted from materials having superior heat insulating effect so as to restrain heat conduction between the sheets 80 and 81. In such an example, by heating the second gas permeability sheets 81 while cooling the first gas permeability sheets 80, a temperature gradient is generated between the sheets 80 and 81, and the permeable holes of the sheets 80 and 81 serve as the passages of width D' between the flat plates 5 or the flat plates 6 in the embodiment shown in FIG. 2A, then the flow of one direction by the thermal edge flow is induced. By setting the permeable holes of the sheets 90 and 81 sufficiently small, even the pressure is comparatively high (an example, about atmospheric pressure), the width D' of the passage between the low-temperature bodies or the high-temperature bodies may be maintained at about the mean free path of gaseous molecules, and even under the high pressure, the pumping function of the invention may be obtained.

Regarding Numerical Analysis

To evaluate performance of the pump apparatus according to the present invention, the results in which the pump apparatus according the present invention has been modeled and the flow has been analyzed will be described blow.

1. Regarding the Issue to be Analyzed

Figure 21A:
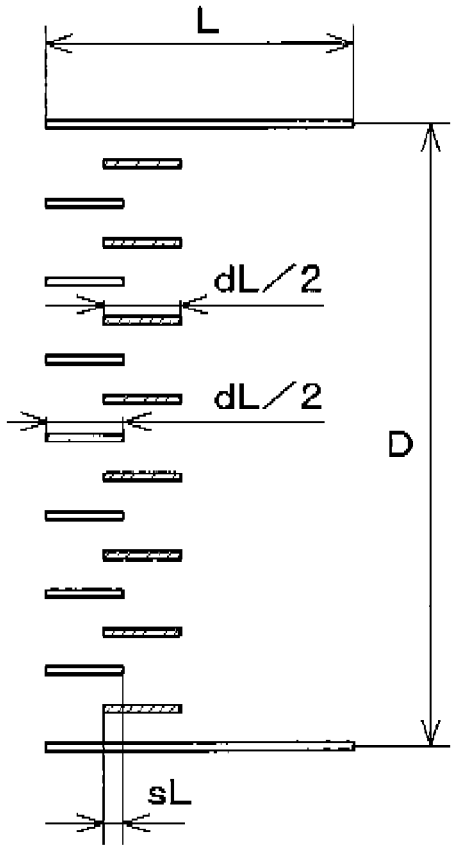
FIG. 21A is a view showing parameters in the model of the pump unit used for analysis.
Figure 21B:
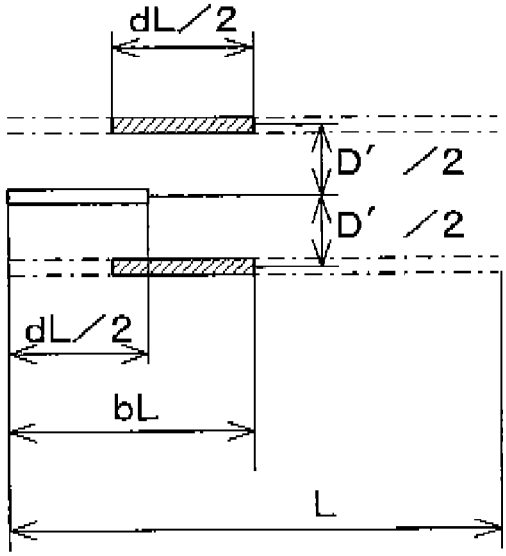
FIG. 21B is a view showing a basic unit in the pump apparatus of FIG. 21A.

Configuration of a pump model of an analysis object is shown in FIG. 21A and FIG. 21B. The model is the entirety of a two-dimension model of the pump unit. The numerical analysis is conducted considering this configuration as one unit of the pump apparatus. The Length of the unit is L, and the diameter (height of the area) of the unit is D. The surface temperature on an inner wall of the unit is $T_0$. One end portion of the unit (left end portion in the figure) is evenly divided into n parts by a plurality of flat plates (temperature $T_0$, width dL/2) which are parallel to the passage. The part closer to the center of the unit than these flat plates, n pieces of flat plates (temperature $T_1$, width dL/2) parallel to the passage are arranged alternately to the flat plates of temperature $T_0$. The entirety of two kinds of flat plate groups of temperatures $T_0$ and $T_1$ have length bL along the passage direction. Therefore, if b<d, as show in the figure, two kinds of flat plate groups make a form as break into each other.

For the pump unit having this configuration, (A) flow rate obtained when temperatures and pressures at both ends of the pump unit are equal to each other, and (B) pressure difference between the both ends of the unit when the flow rate at the pump unit is 0, are examined as the first issue (issue 1).

The pump unit has a lot of partition plates therein. If the number of the partition plates is sufficiently great, it is expected that the flow of which a period D'=D/n in a direction perpendicular to the passage occurs at the central of the unit. Therefore, as the second issue (issue 2), a pair of partitions are taken as regarded as a basic region, and with respect to the pump performance thereof, the analysis as same as the above issue is conducted. The configuration of the basic region is shown in FIG. 21B. It is a two-dimensional region of length L and width D', and in the middle of the top and bottom wall surfaces, a horizontal solid wall of width dL/2 and temperature $T_0$ is arranged. In the top and bottom wall surfaces, each part of widths dL/2 is the solid wall of temperature $T_1$, and the remaining part is a mirror reflection wall surface, and the right side end of the solid part is away from the left end of the entire region by only bL.

2. Precondition of the Analysis

The analysis is carried out under the following assumptions.

Behavior of gas is described by the Boltzmann equation for hard sphere molecules.

At the solid boundary, gaseous molecules make the diffuse reflection.

Selecting the representative length of gas region as D' and the reference temperature as $T_0$, and the mean density in the gas region as a reference density $\rho_0$, then making a fundamental equation and a boundary condition be dimensionless, the parameters of the issues become as follows.

(1) Issue 1 (Simulation of Basic Unit)

Temperature ratio $Tr=T_1/T_0$ degree of rarefaction $Kn=1_0/D'$

Aspect ratio of basic region L/D'

(or, aspect ratio of region L/D (=(1/n)×(L/D'))

Number of passages n

Length of driving portion d

Overlap of flat plates s

Here, $1_0$ is the mean free path of the molecules in the gas at the stationary equilibrium state of temperature $T_0$ and density $\rho_0$.

(2) Issue 2 (Simulation of Basic Passage)

Temperature ratio $Tr=T_1/T_0$ degree of rarefaction $Kn=1_0/D'$

Aspect ratio of region L/D'

Length of driving portion d

Overlap of flat plates s

In the following, as far as it is referred to another way, it is regarded that Tr=3. Here, it is considered the case in which an adjacent right edge of the flat plate with the temperature $T_0$ and a left edge of the flat plate with the temperature $T_1$ make an angle of 135 degrees (sL=D'/2). Further, so that length dL−sL of the driving portion of the pump unit becomes L/2, the case d=1/2+s is considered. As for the coordinate system, $X_1$ direction of the orthogonal coordinate system $X_1$ is made to be an axis direction of the pump (passage), and the flow is assumed to be two dimensional in $X_1$–$X_2$ plane. The origin is at the central left end of the gas region. Due to symmetry, only the region of $X_2>0$ is analyzed. DSMC direct simulation method is used for the analysis.

3. Analysis A (Regarding Maximum Flow Rate)

Periodic boundary conditions are given at both edges of the pump unit, and mass flow rate $M_f$ to be acquired inside of the unit is obtained. This corresponds to the case in which the pressures at both ends of the pump accord with each other. Then, the maximum mass flow rate to be acquired in the pump is obtained. The mass flow rate is determined as follows.

$$M_f = \int_{-D/2}^{D/2} \rho v_1 dX_2 \text{ (issue 1)}, \int_{-D'/2}^{D'/2} \rho v_1 dX_2 \text{ . (issue 2)},$$

Here, ρ, $v_i$ are the density of gas and the flow velocity, respectively.

For convenience of comparing mass flow rates of the issue 1 and the issue 2, non-dimensional mass flow rate $m_f$ can be expressed as follows.

$$m_f = \frac{M_f}{\rho_0(2RT_0)^{1/2}D} \text{ (issue 1)}, \frac{M_f}{\rho_0(2RT_0)^{1/2}D'} \text{ (issue 2)},$$

Non-dimensional mass flow rate $m_f$ of the issue 1 can be expressed as follows.

$$m_f = \frac{M_f/n}{\rho_0(2RT_0)^{1/2}D'},$$

Therefore, $m_f$ in the issue 1 may be considered as the value which is made to be dimensionless for the flow rate per one basic passage as same as in the case of the issue 2. To reduce an oscillation of the result affected by the use of DSMC numerical calculation, using the fact that $M_f$ takes a constant value for $X_1$, the numerical values are calculated by the following equations.

$$M_f = \frac{1}{L}\int_0^L \int_{-D/2}^{D/2} \rho v_1 dX_1 dX_2 \text{ (issue 1)},$$

$$\frac{1}{L}\int_0^L \int_{-D'/2}^{D'/2} \rho v_1 dX_1 dX_2 \text{ (issue 2)},$$

Figure 22:
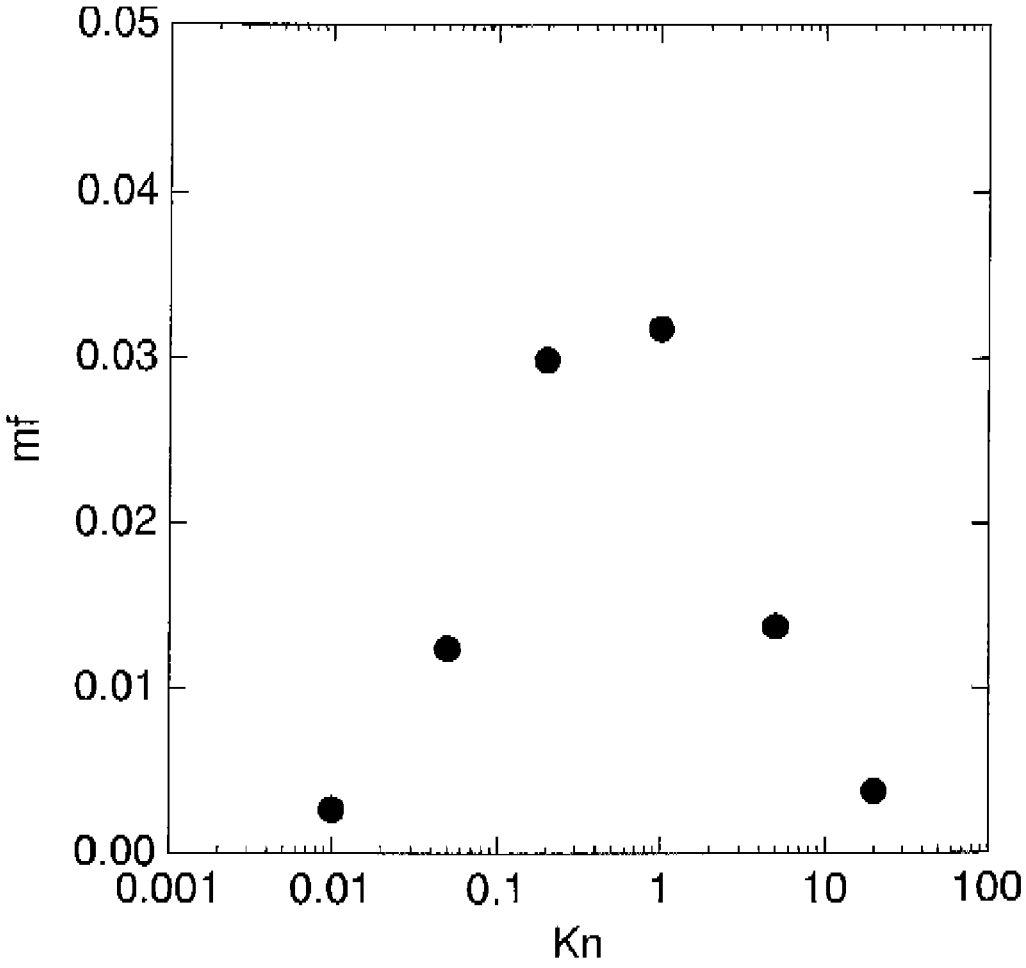
FIG. 22 is a view showing a relation between degree of rarefaction and mass flow rate.
Figure 23A:
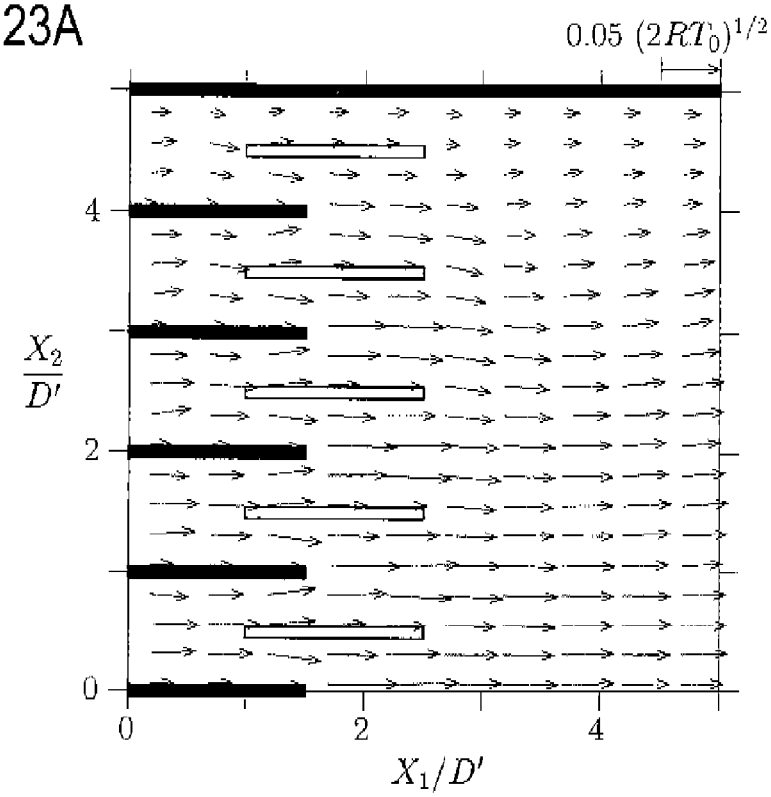
FIG. 23A is a view showing an analysis result of flow in the pump apparatus according to one embodiment of the present invention.
Figure 23B:
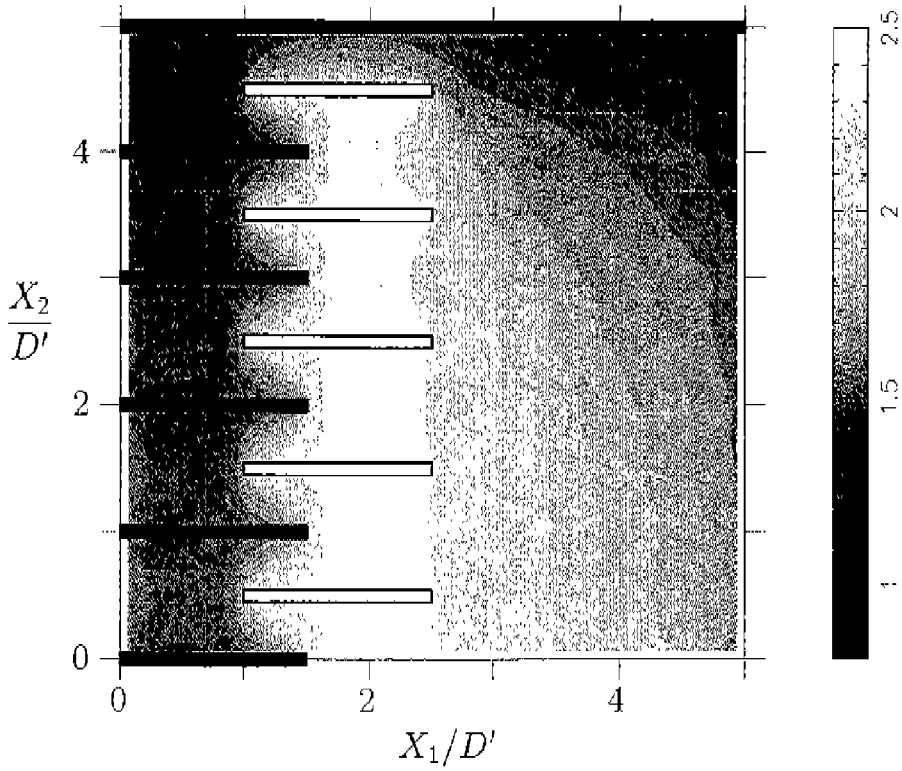
FIG. 23B is a view showing an analysis result of a temperature field in the pump apparatus according to one embodiment of the present invention.

First, the result of the issue 1 is shown. FIG. 22 shows the result in which it was set as L/D'=5, n=10, d=0.6, s=0.1, Tr=3, and the mass flow rate $M_f$ in the stationary state was calculated for various values of the degree of rarefaction Kn. As it can be understood from the figure, the maximum flow rate was obtained in the range of Kn=0.1-1. The simulation result in the case of L/D'=5, n=10, Kn=1.0 is shown in FIGS. 23A and 23B. FIG. 23A is the state of the velocity field. The scale of the flow velocity is shown on the upper right of the figure (R is a gas constant per unitary mass). FIG. 23B shows the state of gas of temperature T by an isopleth diagram of $T/T_0$.

As apparent from these figures, a great temperature gradient is generated in the overlapping portion of two kinds of flat plate groups of which temperatures are different. As compared with this temperature gradient, the temperature gradient becomes small at the flat plate end portion on the opposite side of the overlapping portion, because temperatures of the surrounding wall surfaces are identical to each other. Due to such a temperature distribution, the thermal edge flow in the $X_1$ direction occurs at the overlapping portion of flat plates. In addition, the flow velocity becomes slow on the flat plates and the wall surface of the unit. Therefore, the tendency that the flow is concentrated to a central portion of the unit is recognized at the section with no flat plate.

In this unit, the flat plate itself merely perform a role to produce temperature distribution of gas, and it should work as a resistance against flow. Accordingly, if the flat plate is too long, the resistance may increase and flow rate may be reduced. To the contrary, if the flat plate is too short, temperature of gas may be hard to rise sufficiently, and the flow rate may be small.

Figure 24:
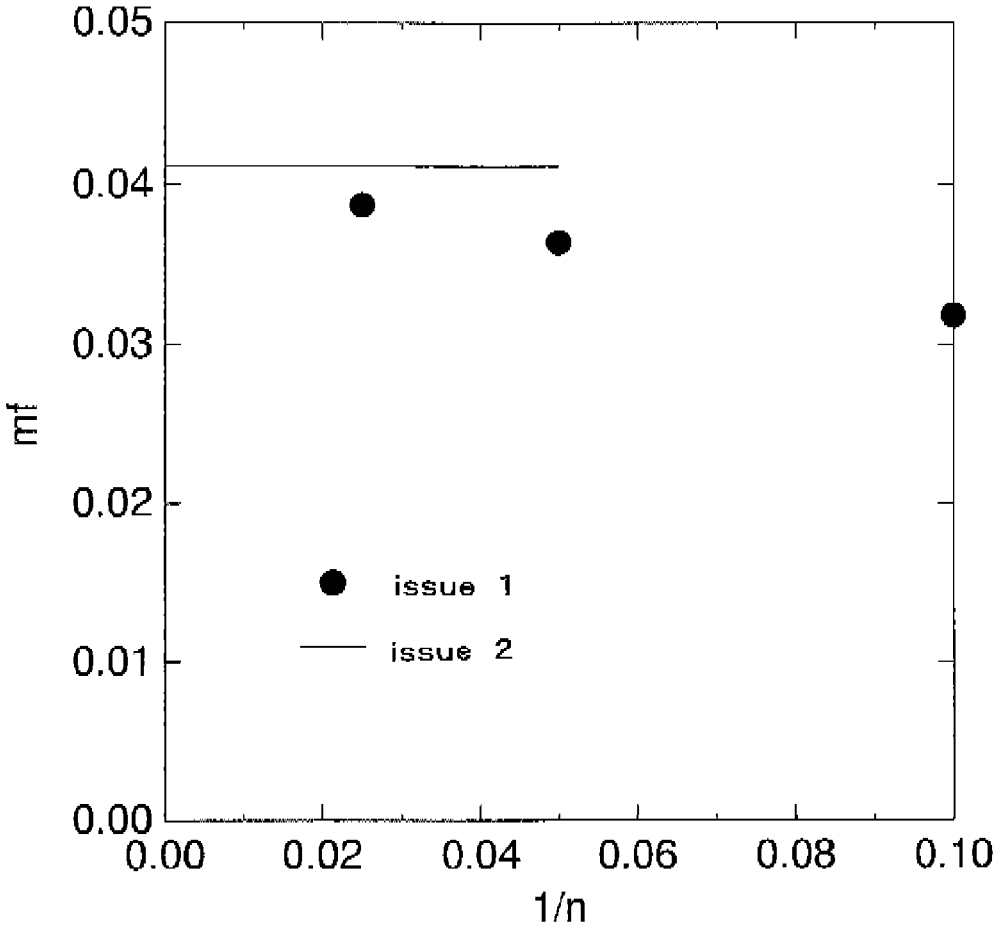
FIG. 24 is a view showing the relation between a number of the passages and a mass flow rate in the basic unit.

Next, the issue 2 will be studied. The comparison between the result of calculating the mass flow rates for cases of n=10, 20 and 40 in the issue 1 at L/D'=5, Kn=1, d=0.6, s=0.1, Tr=3 and the result of calculating the mass flow rates in the issue 2 is shown in FIG. 24. As the number of the passages n increases, the mass flow rate in the issue 1 approaches the result in the issue 2. The difference between both is approximately proportional to 1/n. From this, with respect to the system in which n is great, the influence of the external wall of the unit can be disregarded, and the performance of the pump unit can be obtained from the result of the issue 2.

4. Analysis B (Regarding the Maximum Pressure Ratio)

Next, the pressure ratio to be acquired in the basic unit will be obtained. The calculation is conducted for the state that the units of which the number is m are connected and both ends are blocked with the diffuse reflection walls. The calculation is conducted at L/D'=5, n=10, Tr=3, d=0.6, s=0.1.

First of all, the cross section average amount $h_S(X_1)$ and the unit average amount $h_D(X_1)$ in the passage are defined as follows.

$$h_S(X_1) = \frac{1}{D}\int_{-D/2}^{D/2} h(X_1, X_2) dX_2,$$

$$h_D(X_1) = \frac{1}{LD}\int_{X_1}^{X_1+L} \int_{-D/2}^{D/2} h(\overline{X}_1, X_2) d\overline{X}_1 dX_2,$$

Figure 25A:
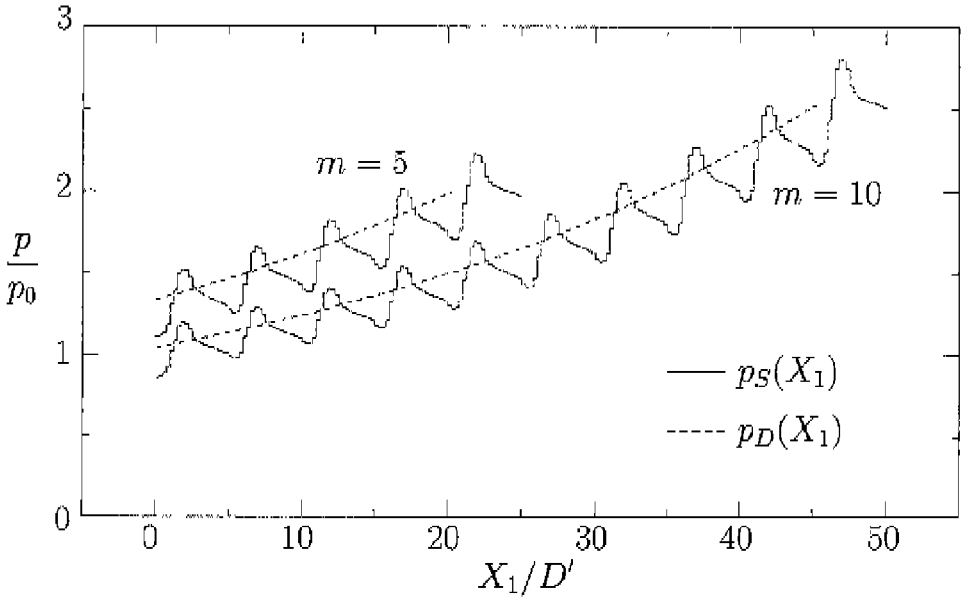
FIG. 25A is a view showing an analysis result of pressure in the pump apparatus according to one embodiment of the present invention.
Figure 25B:
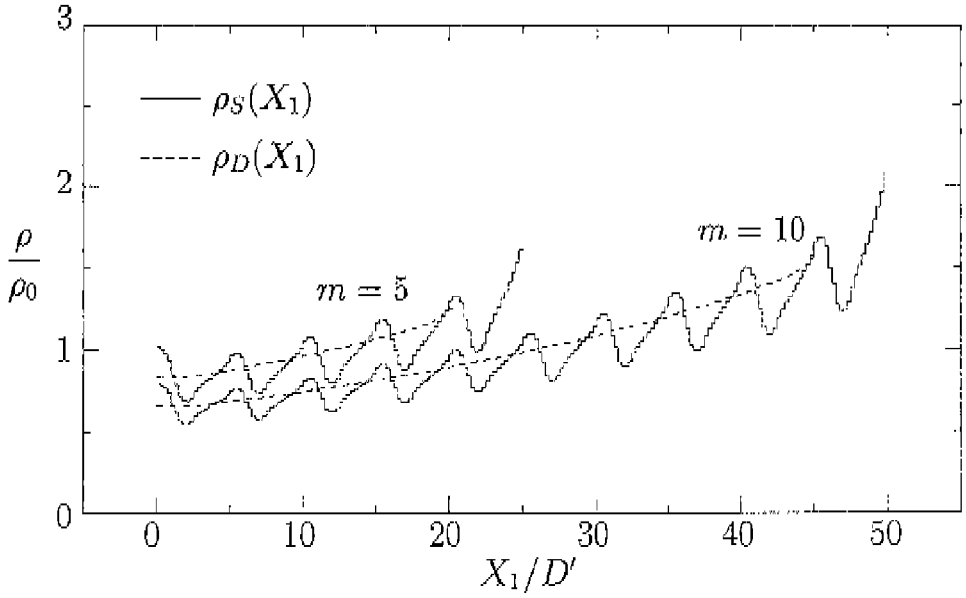
FIG. 25B is a view showing an analysis result of number density in the pump apparatus according to one embodiment of the present invention.

The distributions of the mean pressures $p_S$ and $p_D$ and distributions of the mean number densities $\rho_S$ and $\rho_D$ in the stationary state are shown in FIGS. 25A and 25B. These are data at Kn=1 and the number of pump units m=5 or 10. Incidentally, the pressure of gas at density $\rho_0$ and temperature $T_0$ is represented by $p_0$ in the figure. As understood from the behavior of the unit average amounts $p_D$ and $\rho_D$, as the whole, the pressure and the density gradients along $X_1$ direction occur.

The local Knudsen number KnR ($X_1$) and the compression ratio $\Pi(X_1)$ of the pump unit are determined as the following equations.

$$Kn_R(X_1) = \frac{Kn\rho_0}{\rho_D(X_1)},$$

$$\Pi(X_1) = \frac{p_S(X_1 + L)}{p_S(X_1)}.$$

Figure 26:
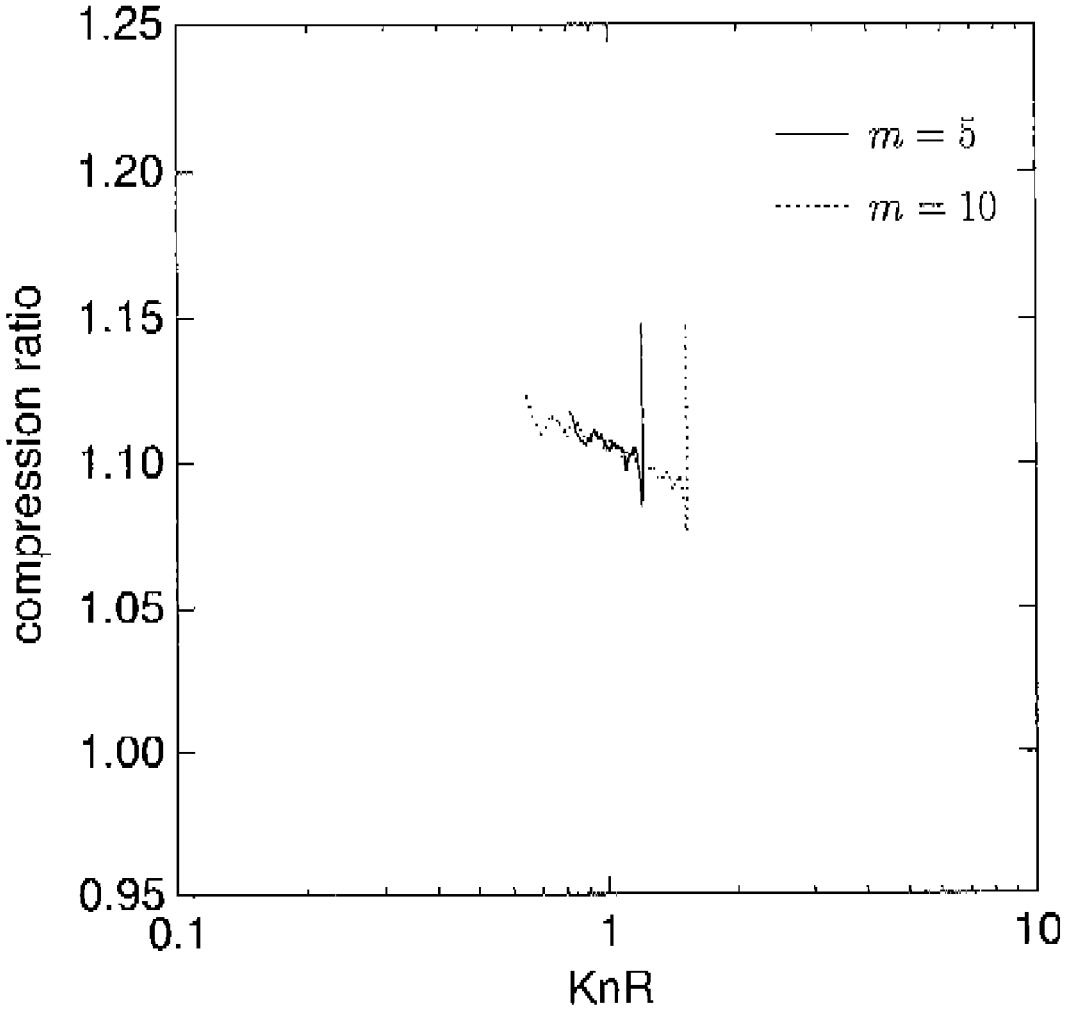
FIG. 26 is a view showing an analysis result of the relation between the degree of rarefaction and compression ratio in the pump apparatus according to one embodiment of the present invention.

The both results are determined from the above data and the relation therebetween is plotted in FIG. 26. The manner that the compression ratio is determined according to the local Knudsen number regardless of the total unit number m can be noticed. Incidentally, ends on the side at which Kn is large do not accord with each other, however, such portions correspond to the rear end of the pump apparatus, and thus it is regarded that the influence that the passage is blocked at the portions appears.

Figure 27:
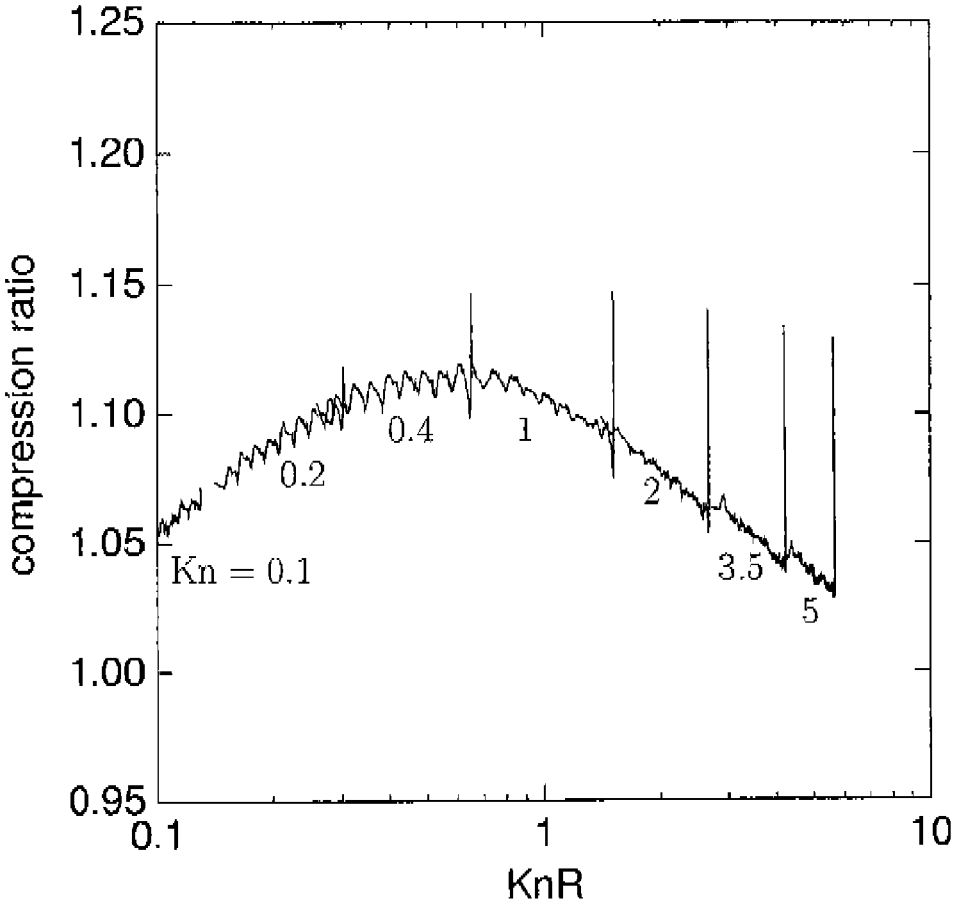
FIG. 27 is a view showing an analysis result of the relation between the degree of rarefaction and compression ratio when ten pump units are joined in the pump apparatus according to one embodiment of the present invention.

Then, in the case in which ten units are connected (m=10), calculations were conducted for various Kn. The Knudsen numbers used in the calculations are Kn=0.1, 0.2, 0.4, 1, 2, 3.5, and 5. The relation between the compression ratio and the local Knudsen number obtained from the results is shown in FIG. 27. The compression ratio per one unit is about 1.1 in maximum.

Figure 28:
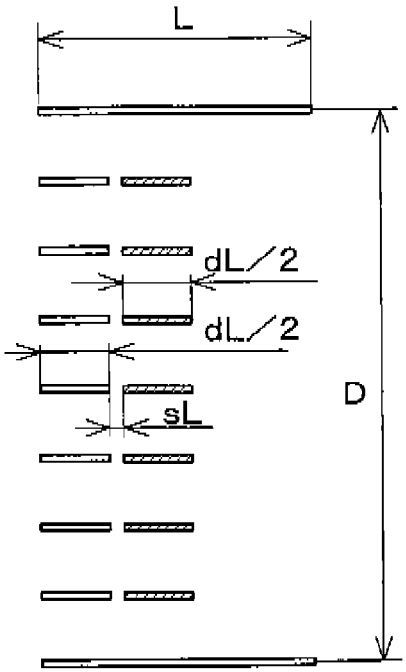
FIG. 28 is a view showing an embodiment in which flat plates are linearly arranged along the flow direction.
Figure 29A:
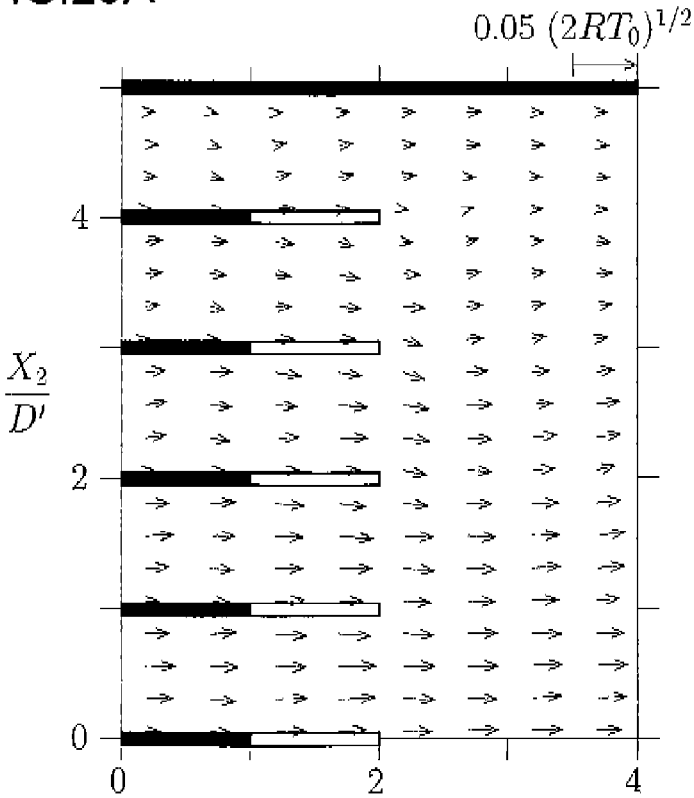
FIG. 29A is a view showing an analysis result of flow in the embodiment of FIG. 28.
Figure 29B:
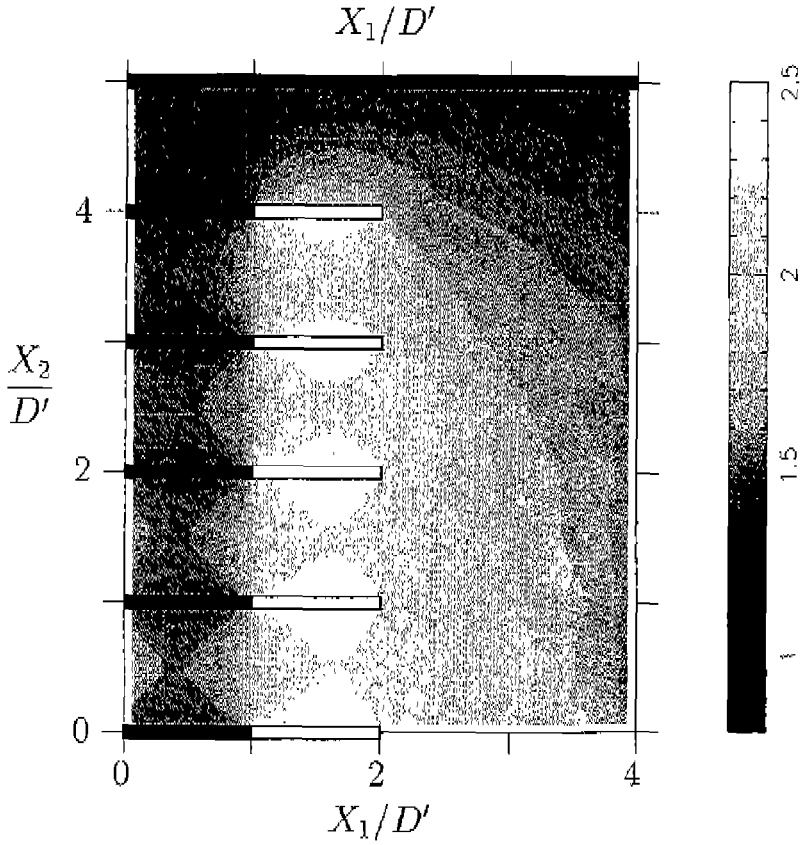
FIG. 29B is a view showing an analysis result of a temperature field in the embodiment of FIG. 28.
Figure 30:
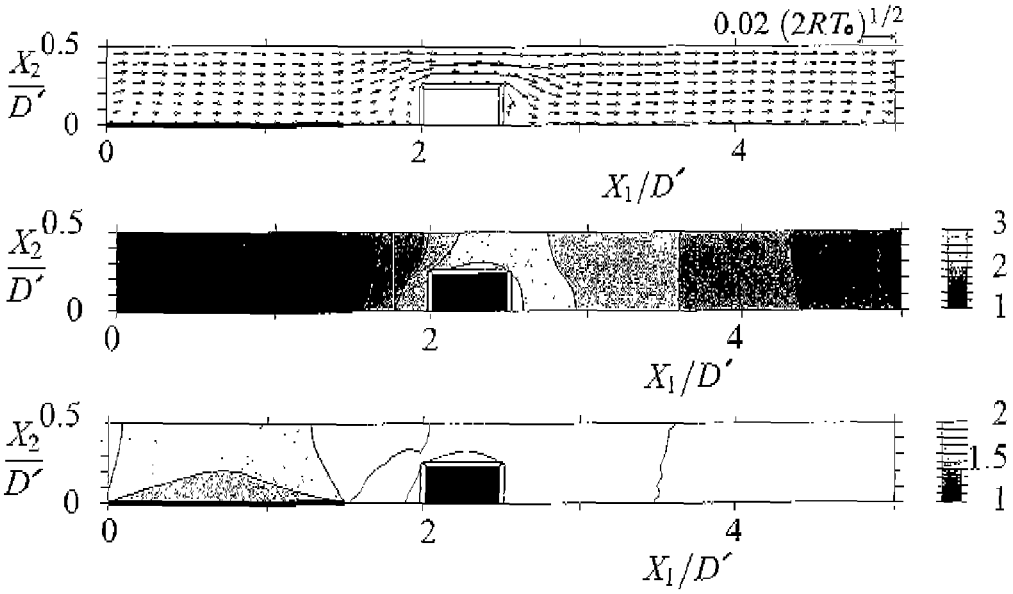
FIG. 30 is a view showing an analysis result of flow in the embodiment of FIG. 3A.
Figure 31:
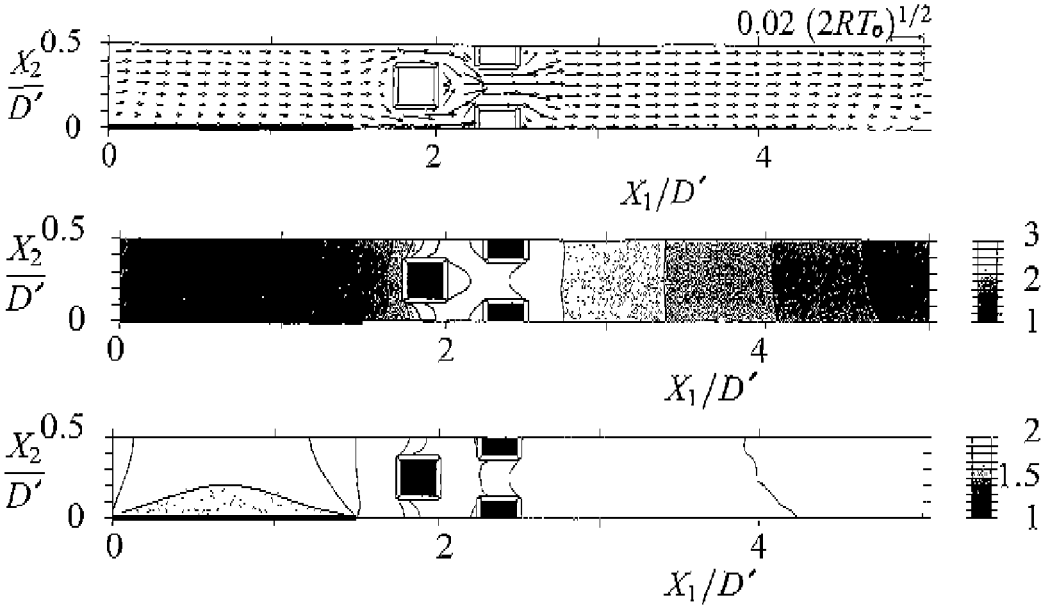
FIG. 31 is a view showing an analysis result of flow in the embodiment of FIG. 3A.
Figure 32:
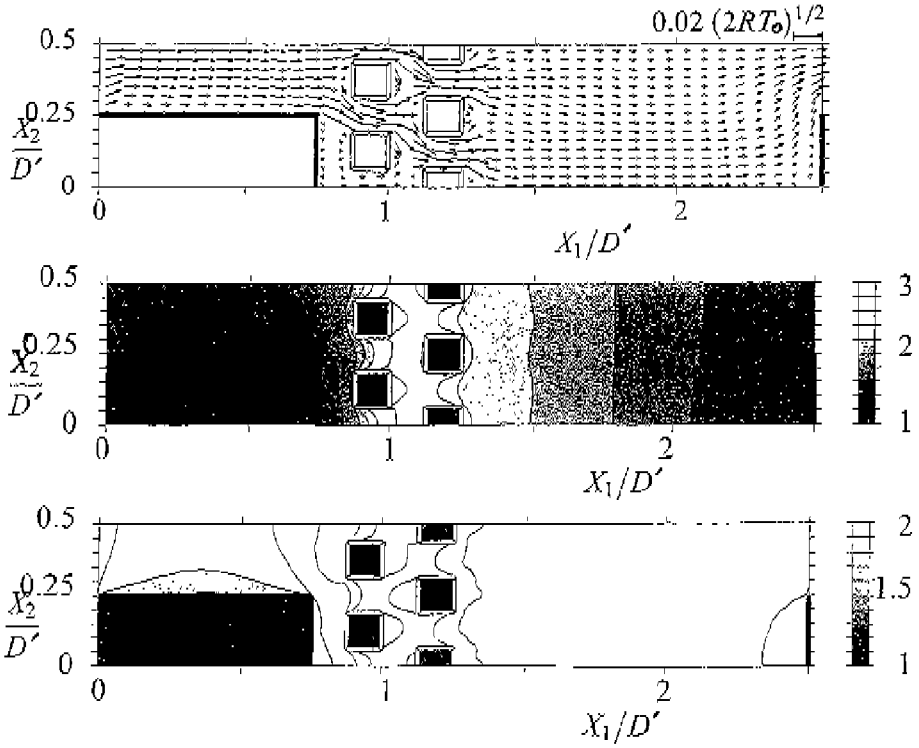
FIG. 32 is a view showing an analysis result of flow in the embodiment of FIG. 3C.
Figure 33:
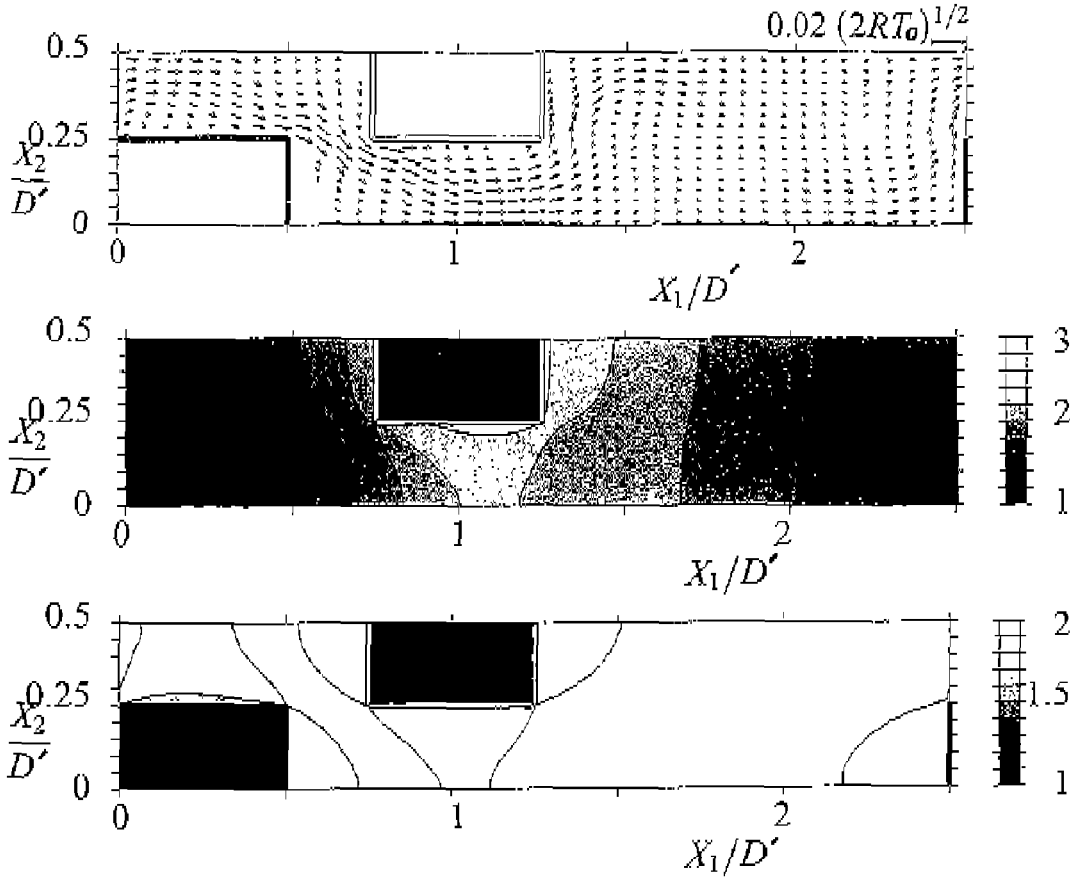
FIG. 33 is a view showing an analysis result of flow in the embodiment of FIG. 3D.

From the results up to here, it is understood that the pump apparatus utilizing the thermal edge flow can be constructed by employing a geometry adopted as a model. In particular, in order to increase the flow velocity of the pump apparatus according to the present invention, it is appropriate to generate greater temperature difference between the flat plate groups. Taking this point into consideration, the model shown in FIG. 2A is one in which the flat plates are alternately arranged each other to thereby make a great temperature gradient. Further, in this configuration, since the low-temperature portion and the high-temperature portion are away from each other, actual fabrication thereof will be easy. However, as shown in FIG. 28, even if the flat plates in the high-temperature flat plate group and the flat plates in the low-temperature flat plate group are linearly arranged along the flow direction with predetermined intervals sL, the flow can be generated. As for the pump apparatus of the type shown in FIG. 28, the result that the velocity field is analyzed by the DSMC method is shown in FIG. 29A, and the state of the temperature field on that occasion is shown in FIG. 29B.

Figure 34:
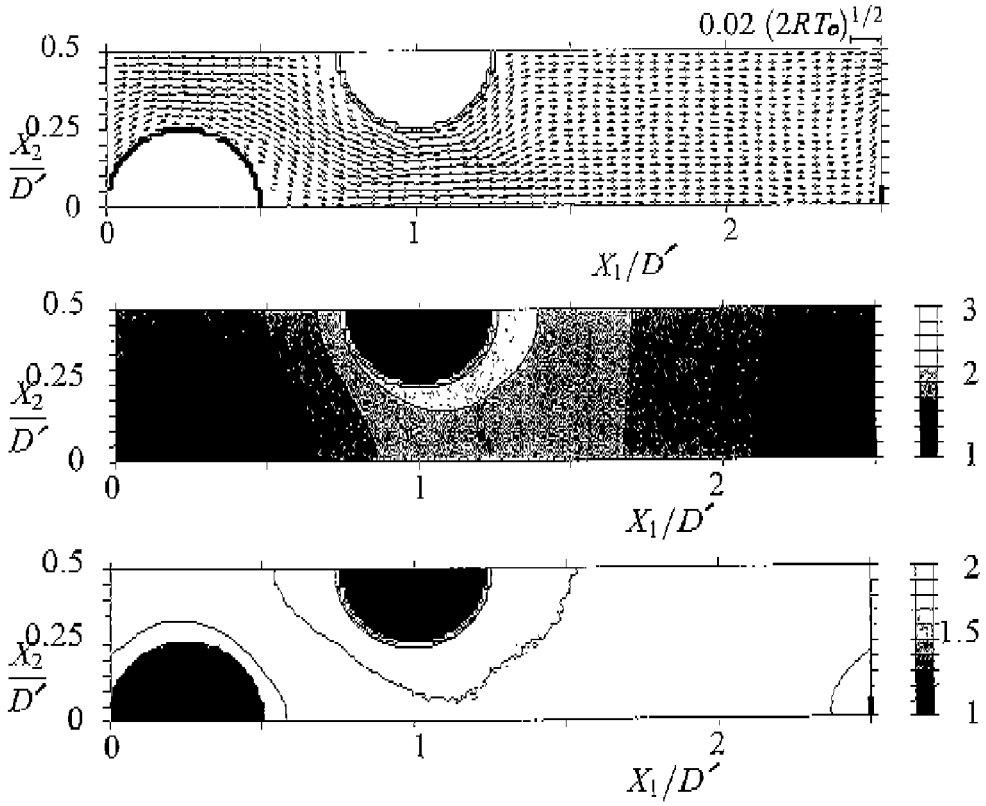
FIG. 34 is a view showing an analysis result of flow in the embodiment of FIG. 3E.
Figure 35:
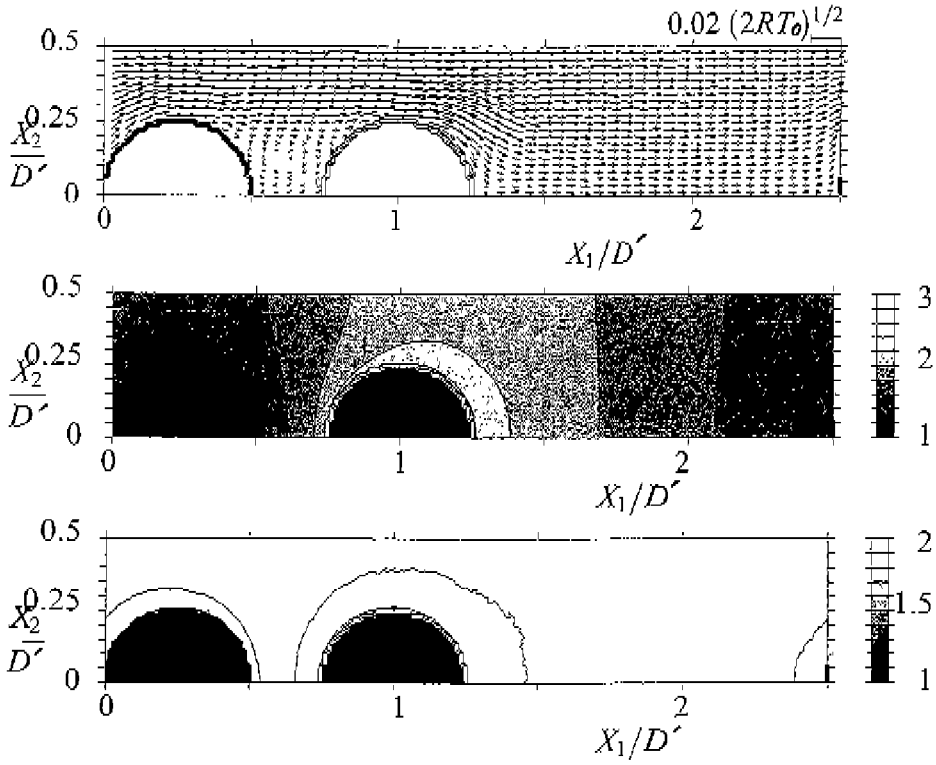
FIG. 35 is view showing an analysis result of flow in a modified example in which the low-temperature bodies and the high-temperature bodies are linearly aligned for an embodiment of FIG. 3E.

Further, the simulation results of the flow field correspond to the embodiments shown in above-descried FIGS. 3A-3E are shown in FIGS. 30-34. In each figure, in the order from the top thereof, the analysis results of the velocity field, the temperature field and the pressure field are shown, respectively. Incidentally, the simulations were conducted for thermal ratio Tr=3 in all cases. The degree of rarefaction (Knudsen number) Kn is Kn=1 in FIG. 30 and FIG. 31 and is Kn=0.5 in FIGS. 32-34. As it is apparent from these figures, in every embodiment, it is understood that one directional flow can be observed from the low-temperature side (left side in each figure) to the high-temperature side. Further, FIG. 35 shows the simulation result of the case in which the low-temperature bodies and the high-temperature bodies of the cylindrical shapes, each of which is shown in FIG. 34, are linearly arranged. In the example of FIG. 35, intensity of one directional flow becomes stronger than the example of FIG. 34. The reason of that is guessed that the flow is not disturbed due to the linearly arrangement of each low-temperature body and each high-temperature body.

Regarding Practical Use System

Figure 36:
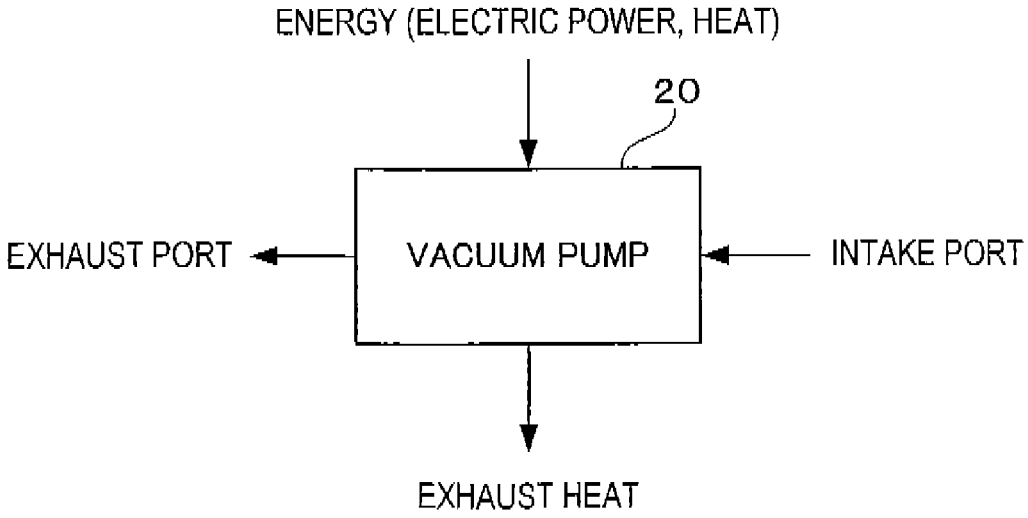
FIG. 36 is a view showing a basic embodiment when the pump apparatus according to the present invention is practically used.
Figure 37:
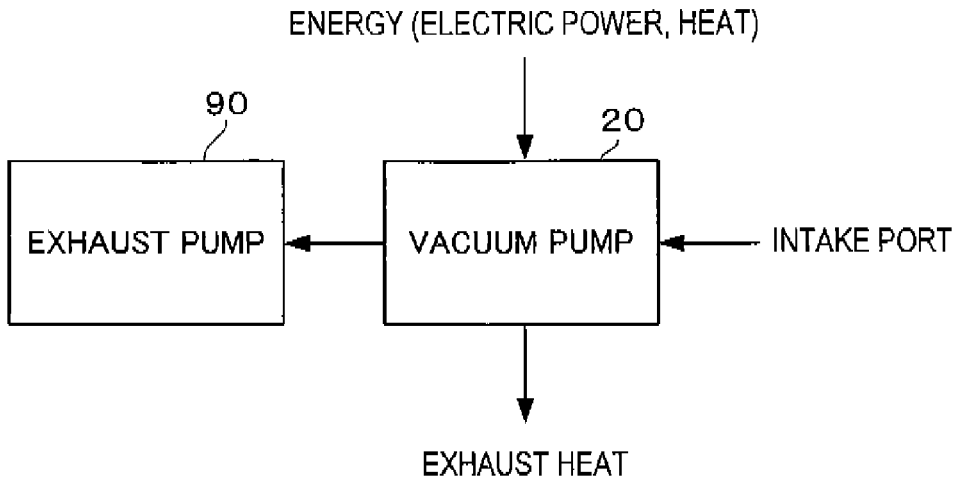
FIG. 37 is a view showing an embodiment in which a pump is added to the exhaust side for the embodiment of FIG. 36.
Figure 38:
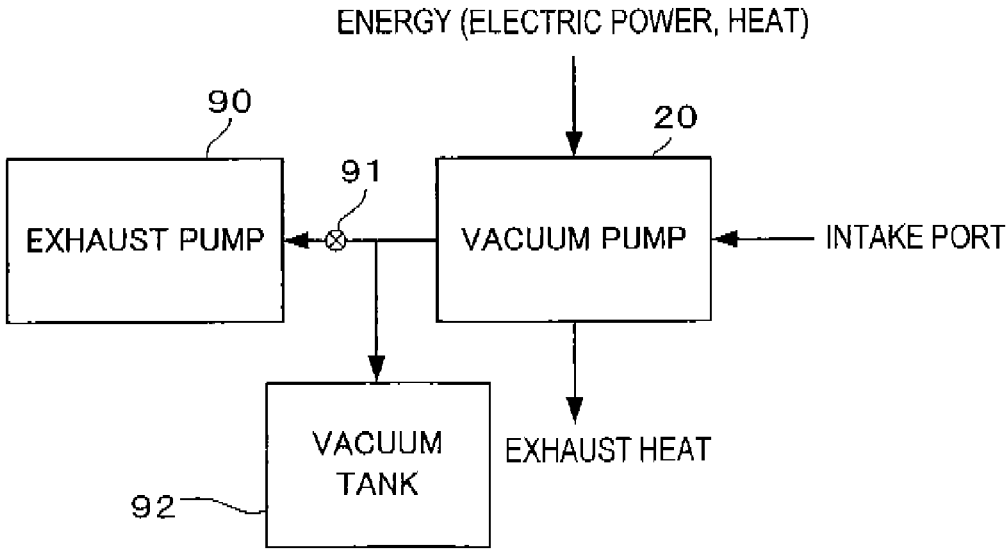
FIG. 38 is a view showing an embodiment in which a vacuum tank is added for the embodiment of FIG. 37.

Minimum configuration when the above-descried pump apparatus is put to practical use is shown in FIG. 36. In this example, energy such as electric power, heat, or the like is given to the vacuum pump 20 and gas flows from the inlet port to the exhaust port with excess heat being exhausted. FIG. 37 is an example in which another exhaust pump 90 is connected to an exhaust side of the vacuum pump 20. In this example, the pump action can efficiently be drawn by operating the exhaust pump 90 to lower the pressure inside the vacuum pump 20 and giving the energy to the pump apparatus 20. As for the exhaust pump 90, a well-known pump such as oil sealed rotary pump can be used. If contamination or oscillation caused by the pump apparatus 90 may be a problem, as shown in FIG. 38, an opening and closing valve 91 may be provided between the vacuum pump 20 and the exhaust pump 90, and the vacuum tank 92 may be connected to the upstream side thereof. In this example, the pressures in the vacuum pump 20 and the vacuum tank 92 are lowered by opening the opening and closing valve 91 and operating the exhaust pump 90, and then the energy is given to the vacuum pump 20 while the opening and closing valve 91 is closed, thereby generating the pump effect by the thermal edge flow and introducing the exhaust from the vacuum pump 20 to the vacuum tank 90. Until the pressure of the vacuum tank 92 rises so that the operation of the vacuum pump 20 stops, gas can be taken without contamination or oscillation from the intake port.

THE INDUSTRIAL FIELD OF USE

The pump apparatus according to the present invention can be applied in the following fields.

(a) Field of Precision Engineering or Field of Material Engineering

In these fields, a minute work or observation is often carried out under low pressure. The pump apparatus according to the present invention, since a liquid such as oil, steam or wax-like material is not required as well as moving parts, oscillation or contamination seen in the vacuum pump of other types is not generated at all. This is very important property when observation or the like with respect to surface physical properties is carried out. Further, since a space between an intake port and an exhaust port of a pump apparatus is not completely closed, there is an advantage that a motion transmission member such as a link or an information transmission member such as a cable can be arranged between the regions of which pressures are different to allow a motion or information to be transmitted.

(b) Field Requiring a Large Flow Rate Pump, Such as Semiconductor Engineering

Since moving parts do not exist in a pump apparatus according to the present invention, a pump apparatus having large diameter and large displacement can easily be realized.

(c) Field of Nuclear Engineering or Space Engineering

As for a pump apparatus according to the present invention, since the structure is simple and no moving parts exist, less necessity of maintenance is required. Accordingly, there is high applicability to a field related to an extreme environment such as an inside of a nuclear reactor or an outer-space.

(d) Field of Space Engineering, Nuclear Engineering, or Chemical Engineering

A pump apparatus according to the present invention has a property that can work as far as a heat source exists. Accordingly, in these fields, it is thinkable that various energy sources such as sunlight or chemical reaction can be used. Since low-temperature is regularly used in a nuclear fusion apparatus, the temperature gradient between the flat plate groups may be produced by utilizing a temperature gradient between the low-temperature and room temperature.

(e) Field of Micro or Nano Engineering

A Knudsen compressor can equally work by changing the scale thereof in proportion to the mean free path of gaseous molecules. Since the structure is simple and miniaturization thereof is easy, a minute pump system capable of working from normal pressure to high pressure can be realized.

(f) Field of Material Processing, Such as Vacuum Drying, which Treats Flow of Gas or Steam of Low Pressure As for a pump apparatus according to the present invention, flow of gas or steam of the low pressure can be generated without generating contamination. Using this feature, it is possible that, in a freeze-drying process, low pressure steam in a periphery of materials is controlled without polluting the materials, or that gas flow in the vacuum device is controlled in the case of manufacturing thin film or performing a metal working in a vacuum chamber.

The invention claimed is:

1. A pump apparatus comprising:

a low-temperature portion having a plurality of low-temperature bodies arranged with intervals in a crossing direction in a pathway of gas;

a high-temperature portion having a plurality of high-temperature bodies arranged with intervals in the crossing direction in the pathway; and a heating or cooling device that controls at least one of temperatures of the low-temperature portion or the high-temperature portion so that a temperature of the high-temperature portion is higher than that of the low-temperature portion, wherein:

the low-temperature bodies and the high-temperature bodies are displaced from each other in a flow direction of the gas in the pathway, and a conductive-heat-transfer insulating layer of the gas exists between the low-temperature bodies and the high-temperature bodies, such that a uni-directional flow of the gas from the low-temperature portion toward the high-temperature portion is induced therebetween by thermal edge flows, which are generated in the vicinity of the low-temperature bodies and the high-temperature bodies at edges thereof with respect to the flow direction of the gas in the pathway; and wherein edges of the low-temperature bodies are positioned in vicinity to respective edges of the high-temperature bodies, such that a distance between the edges of the low temperature bodies and the edges of the high-temperature bodies in vicinity to one another in the crossing direction does not exceed either of a distance between adjacent ones of the low-temperature bodies in the crossing direction and a distance between adjacent ones of the high-temperature bodies in the crossing direction; wherein the distance between the edges of the low temperature bodies and the edges of the high temperature bodies is measured in the direction perpendicular to the thermal edge flow direction.

2. The pump apparatus according to claim 1, wherein the low-temperature bodies and the high-temperature bodies are alternately arranged with respect to the crossing direction.

3. The pump apparatus according to claim 2, wherein the low-temperature bodies and the high-temperature bodies are partly overlapped in the flow direction.

4. The pump apparatus according to claim 1, wherein the high-temperature bodies and the low-temperature bodies are linearly arranged in the flow direction.

5. The pump apparatus according to claim 1, wherein a group of first flat plates arranged parallel with each other in the crossing direction are provided as the low-temperature bodies in the low-temperature portion, and a group of second flat plates arranged parallel with each other in the crossing direction are provided as the high-temperature bodies in the high-temperature portion.

6. The pump apparatus according to claim 1, wherein at least one of each low-temperature body or each high-temperature body is configured in a column shape.

7. The pump apparatus according to claim 1, wherein a porous material body is provided as at least one of the low-temperature portion or the high-temperature portion, and wall portions surrounding permeable holes of the porous material body serve as the low-temperature bodies or the high-temperature bodies.

8. The pump apparatus according to claim 1, wherein edges of vicinity portions of each of the low-temperature bodies and the high-temperature bodies have a radius of curvature equal to or less than a mean free path of gaseous molecules.

9. The pump apparatus according to claim 1, wherein a plurality of pump units are connected with respect to the flow direction, and the low-temperature portion and the high-temperature portion are provided in each pump unit.

10. The pump unit according to claim 1, wherein each individual body of the plurality of low-temperature bodies and each individual body of the plurality of high-temperature bodies are displaced from each other in a flow direction and the crossing direction in the passage.

11. The pump unit according to claim 1, wherein each of the individual bodies of the plurality of low-temperature bodies and each individual bodies of the plurality of high-temperature bodies have a flat surface and an edge, wherein the edges of the low-temperature bodies and the edges of the high-temperature bodies are oriented in the flow direction.

12. A pump unit comprising:

a low-temperature portion having a plurality of low-temperature bodies arranged with intervals in a crossing direction in a pathway of gas; and a high-temperature portion having a plurality of high-temperature bodies arranged with intervals in the crossing direction in the pathway, wherein the low-temperature bodies and the high-temperature bodies are displaced from each other in a flow direction in the pathway, and a conductive-heat-transfer insulating layer of the gas exists between the low-temperature bodies and the high-temperature bodies, such that a uni-directional flow of the gas from the low-temperature portion toward the high-temperature portion is induced therebetween by thermal edge flows, which are generated in the vicinity of the low-temperature bodies and the high-temperature bodies at edges thereof with respect to the flow direction of the gas in the pathway, wherein edges of the low-temperature bodies are positioned in vicinity to respective edges of the high-temperature bodies, such that a distance between the edges of the low temperature bodies and the edges of the high-temperature bodies in vicinity to one another in the crossing direction does not exceed either of a distance between adjacent ones of the low-temperature bodies in the crossing direction and a distance between adjacent ones of the high-temperature bodies in the crossing direction; wherein the distance between the edges of the low temperature bodies and the edges of the high temperature bodies is measured in the direction perpendicular to the thermal edge flow direction.

13. The pump unit according to claim 12, wherein a group of first flat plates arranged parallel with each other in the crossing direction are provided as the low-temperature bodies in the low-temperature portion, and a group of second flat plates arranged parallel with each other in the crossing direction are provided as the high-temperature bodies in the high-temperature portion.

14. The pump unit according to claim 13, comprising a hollow flange constructing a pump housing and a heater unit connected to the flange through a heat insulating portion, wherein the group of the first flat plates are attached to the flange so as to cross a hollow portion of the flange, and the heater unit is provided with a heating element made by folding a heating wire material in a meandering form so as to form the group of the second flat plates.

15. The pump unit according to claim 14, wherein the heater unit is provided with a frame to which the heating element is attached and a wire stretched around the frame, and connection means for connecting the wire and the flange serves as the heat insulating portion.

16. The pump unit according to claim 15, wherein a plurality of pipe-like insulation members are fixed to the frame, the wire is connected to the frame by being passed through the insulating members and the connection means connects the flange and the wire.

17. The pump unit according to claim 15, wherein the connection means includes a floating mechanism supporting the heater unit at a plurality of points.

18. The pump unit according to claim 13, wherein the flange is provided with a coolant passage through which a coolant passes.

* * * * *